US007986113B2

(12) United States Patent
Gorrell et al.

(10) Patent No.: US 7,986,113 B2
(45) **Date of Patent: *Jul. 26, 2011**

(54) SELECTABLE FREQUENCY LIGHT EMITTER

(75) Inventors: Jonathan Gorrell, Gainesville, FL (US); Mark Davidson, Florahome, FL (US)

(73) Assignee: Virgin Islands Microsystems, Inc., Saint Thomas, VI (US)

( * ) Notice: Subject to any disclaimer, the term of this patent is extended or adjusted under 35 U.S.C. 154(b) by 1060 days.

This patent is subject to a terminal disclaimer.

(21) Appl. No.: 11/418,096

(22) Filed: May 5, 2006

(65) Prior Publication Data

US 2007/0257619 A1 Nov. 8, 2007

(51) Int. Cl.
*H05B 35/00* (2006.01)

(52) U.S. Cl. ..... 315/500; 315/5.43; 250/396 R; 250/495.1

(58) Field of Classification Search ..... 315/4, 5, 315/5.19, 5.21, 5.42, 5.43, 500, 501, 505; 250/492.24, 492.3, 493.1, 494.1, 396 R, 495.1
See application file for complete search history.

(56) References Cited

U.S. PATENT DOCUMENTS

| | | | |
|---|---|---|---|
| 1,948,384 | A | 2/1934 | Lawrence |
| 2,307,086 | A | 1/1943 | Varian et al. |
| 2,431,396 | A | 11/1947 | Hansell |
| 2,473,477 | A | 6/1949 | Smith |
| 2,634,372 | A | 4/1953 | Salisbury |
| 2,932,798 | A | 4/1960 | Kerst et al. |
| 2,944,183 | A | 7/1960 | Drexler |
| 2,966,611 | A | 12/1960 | Sandstrom |
| 3,231,779 | A | 1/1966 | White |
| 3,274,428 | A | 9/1966 | Neville |
| 3,297,905 | A | 1/1967 | Fiedor et al. |
| 3,315,117 | A | 4/1967 | Udelson |
| 3,387,169 | A | 6/1968 | Farney |
| 3,543,147 | A | 11/1970 | Kovarik |
| 3,546,524 | A | 12/1970 | Stark |

(Continued)

FOREIGN PATENT DOCUMENTS

EP 0237559 B1 12/1991

(Continued)

OTHER PUBLICATIONS

U.S. Appl. No. 11/418,082, filed May 5, 2006, Gorrell et al.

(Continued)

*Primary Examiner* — Haissa Philogene
(74) *Attorney, Agent, or Firm* — Davidson Berquist Jackson & Gowdey, LLP

(57) ABSTRACT

We describe an ultra-small resonant structure that produces electromagnetic radiation (e.g., visible light) at selected frequencies that can also be used or formed in conjunction with passive optical structures. The resonant structure can be produced from any conducting material (e.g., metal such as silver or gold). The passive optical structures can be formed from glass, polymer, dielectrics, or any other material sufficiently transparent using conventional patterning, etching and deposition techniques. The passive optical structures can be formed directly on the ultra-small resonant structures, or alternatively on an intermediate structure, or the passive optical structures can be formed in combination with other passive optical structures. The size and dimension of the passive optical structures can be identical with underlying structures, they can merely extend outwardly beyond an exterior shape of the underlying structure, or the passive optical structures can span across a plurality of the underlying structures, including in each instance embodiments with and without the intermediate structures.

16 Claims, 29 Drawing Sheets

U.S. PATENT DOCUMENTS 3,560,694 A 2/1971 White
3,571,642 A 3/1971 Westcott
3,586,899 A 6/1971 Fleisher
3,761,828 A 9/1973 Pollard et al.
3,886,399 A 5/1975 Symons
3,923,568 A 12/1975 Bersin
3,989,347 A 11/1976 Eschler
4,053,845 A 10/1977 Gould
4,269,672 A 5/1981 Inoue
4,282,436 A 8/1981 Kapetanakos
4,296,354 A 10/1981 Neubauer
4,450,554 A 5/1984 Steensma et al.
4,453,108 A * 6/1984 Freeman, Jr. ..... 315/5.18
4,482,779 A 11/1984 Anderson
4,528,659 A 7/1985 Jones, Jr.
4,589,107 A 5/1986 Middleton et al.
4,598,397 A 7/1986 Nelson et al.
4,630,262 A 12/1986 Callens et al.
4,652,703 A 3/1987 Lu et al.
4,661,783 A 4/1987 Gover et al.
4,704,583 A 11/1987 Gould
4,712,042 A 12/1987 Hamm
4,713,581 A 12/1987 Haimson
4,727,550 A 2/1988 Chang et al.
4,740,963 A 4/1988 Eckley
4,740,973 A 4/1988 Madey
4,746,201 A 5/1988 Gould
4,761,059 A 8/1988 Yeh et al.
4,782,485 A 11/1988 Gollub
4,789,945 A 12/1988 Niijima
4,806,859 A 2/1989 Hetrick
4,809,271 A 2/1989 Kondo et al.
4,813,040 A 3/1989 Futato
4,819,228 A 4/1989 Baran et al.
4,829,527 A 5/1989 Wortman et al.
4,838,021 A 6/1989 Beattie
4,841,538 A 6/1989 Yanabu et al.
4,864,131 A 9/1989 Rich et al.
4,866,704 A 9/1989 Bergman
4,866,732 A 9/1989 Carey et al.
4,873,715 A 10/1989 Shibata
4,887,265 A 12/1989 Felix
4,890,282 A 12/1989 Lambert et al.
4,898,022 A 2/1990 Yumoto et al.
4,912,705 A 3/1990 Paneth et al.
4,932,022 A 6/1990 Keeney et al.
4,981,371 A 1/1991 Gurak et al.
5,023,563 A 6/1991 Harvey et al.
5,036,513 A 7/1991 Greenblatt
5,065,425 A 11/1991 Lecomte et al.
5,113,141 A 5/1992 Swenson
5,121,385 A 6/1992 Tominaga et al.
5,127,001 A 6/1992 Steagall et al.
5,128,729 A 7/1992 Alonas et al.
5,130,985 A 7/1992 Kondo et al.
5,150,410 A 9/1992 Bertrand
5,155,726 A 10/1992 Spinney et al.
5,157,000 A 10/1992 Elkind et al.
5,163,118 A 11/1992 Lorenzo et al.
5,185,073 A 2/1993 Bindra et al.
5,187,591 A 2/1993 Guy et al.
5,199,918 A 4/1993 Kumar
5,214,650 A 5/1993 Renner et al.
5,233,623 A 8/1993 Chang
5,235,248 A 8/1993 Clark et al.
5,262,656 A 11/1993 Blondeau et al.
5,263,043 A 11/1993 Walsh
5,268,693 A 12/1993 Walsh
5,268,788 A 12/1993 Fox et al.
5,282,197 A 1/1994 Kreitzer
5,283,819 A 2/1994 Glick et al.
5,293,175 A 3/1994 Hemmie et al.
5,302,240 A 4/1994 Hori et al.
5,305,312 A 4/1994 Fornek et al.
5,341,374 A 8/1994 Lewen et al.
5,354,709 A 10/1994 Lorenzo et al.
5,446,814 A 8/1995 Kuo et al.
5,485,277 A 1/1996 Foster
5,504,341 A 4/1996 Glavish
5,578,909 A 11/1996 Billen
5,604,352 A 2/1997 Schuetz
5,608,263 A 3/1997 Drayton et al.
5,637,966 A 6/1997 Umstadter et al.
5,663,971 A 9/1997 Carlsten
5,666,020 A 9/1997 Takemura
5,668,368 A 9/1997 Sakai et al.
5,705,443 A 1/1998 Stauf et al.
5,737,458 A 4/1998 Wojnarowski et al.
5,744,919 A 4/1998 Mishin et al.
5,757,009 A 5/1998 Walstrom
5,767,013 A 6/1998 Park
5,780,970 A 7/1998 Singh et al.
5,790,585 A 8/1998 Walsh
5,811,943 A 9/1998 Mishin et al.
5,821,836 A 10/1998 Katehi et al.
5,821,902 A 10/1998 Keen
5,825,140 A 10/1998 Fujisawa
5,831,270 A 11/1998 Nakasuji
5,847,745 A 12/1998 Shimizu et al.
5,858,799 A 1/1999 Yee et al.
5,889,449 A 3/1999 Fiedziuszko
5,889,797 A 3/1999 Nguyen
5,902,489 A 5/1999 Yasuda et al.
5,963,857 A 10/1999 Greywall
5,972,193 A 10/1999 Chou et al.
6,005,347 A 12/1999 Lee
6,008,496 A 12/1999 Winefordner et al.
6,040,625 A 3/2000 Ip
6,060,833 A 5/2000 Velazco
6,080,529 A 6/2000 Ye et al.
6,117,784 A 9/2000 Uzoh
6,139,760 A 10/2000 Shim et al.
6,180,415 B1 1/2001 Schultz et al.
6,195,199 B1 2/2001 Yamada
6,210,555 B1 4/2001 Taylor et al.
6,222,866 B1 4/2001 Seko
6,278,239 B1 8/2001 Caporaso et al.
6,281,769 B1 8/2001 Fiedziuszko
6,297,511 B1 10/2001 Syllaios et al.
6,301,041 B1 10/2001 Yamada
6,303,014 B1 10/2001 Taylor et al.
6,309,528 B1 10/2001 Taylor et al.
6,316,876 B1 11/2001 Tanabe
6,338,968 B1 1/2002 Hefti
6,370,306 B1 4/2002 Sato et al.
6,373,194 B1 4/2002 Small
6,376,258 B2 4/2002 Hefti
6,407,516 B1 6/2002 Victor
6,441,298 B1 8/2002 Thio
6,448,850 B1 9/2002 Yamada
6,453,087 B2 9/2002 Frish et al.
6,470,198 B1 10/2002 Kintaka et al.
6,504,303 B2 1/2003 Small
6,524,461 B2 2/2003 Taylor et al.
6,525,477 B2 2/2003 Small
6,534,766 B2 3/2003 Abe et al.
6,545,425 B2 4/2003 Victor
6,552,320 B1 4/2003 Pan
6,577,040 B2 6/2003 Nguyen
6,580,075 B2 6/2003 Kametani et al.
6,603,781 B1 8/2003 Stinson et al.
6,603,915 B2 8/2003 Glebov et al.
6,624,916 B1 9/2003 Green et al.
6,636,185 B1 10/2003 Spitzer et al.
6,636,534 B2 10/2003 Madey et al.
6,636,653 B2 10/2003 Miracky et al.
6,640,023 B2 10/2003 Miller et al.
6,642,907 B2 11/2003 Hamada et al.
6,687,034 B2 2/2004 Wine et al.
6,700,748 B1 3/2004 Cowles et al.
6,724,486 B1 4/2004 Shull et al.
6,738,176 B2 5/2004 Rabinowitz et al.
6,741,781 B2 5/2004 Furuyama
6,777,244 B2 * 8/2004 Pepper et al. ..... 436/165
6,782,205 B2 8/2004 Trisnadi et al.
6,791,438 B2 9/2004 Takahashi et al.
6,800,877 B2 10/2004 Victor et al.

6,801,002 B2 10/2004 Victor et al.
6,808,955 B2 10/2004 Ma
6,819,432 B2 11/2004 Pepper et al.
6,829,286 B1 12/2004 Guilfoyle et al.
6,831,301 B2 12/2004 Murphy et al.
6,834,152 B2 12/2004 Gunn et al.
6,870,438 B1 3/2005 Shino et al.
6,871,025 B2 3/2005 Maleki et al.
6,885,262 B2 4/2005 Nishimura et al.
6,900,447 B2 5/2005 Gerlach et al.
6,908,355 B2 6/2005 Habib et al.
6,909,092 B2 6/2005 Nagahama
6,909,104 B1 6/2005 Koops
6,924,920 B2 8/2005 Zhilkov
6,936,981 B2 8/2005 Gesley
6,943,650 B2 9/2005 Ramprasad et al.
6,944,369 B2 9/2005 Deliwala
6,952,492 B2 10/2005 Tanaka et al.
6,953,291 B2 10/2005 Liu
6,954,515 B2 10/2005 Bjorkholm et al.
6,965,284 B2 11/2005 Maekawa et al.
6,965,625 B2 11/2005 Mross et al.
6,972,439 B1 12/2005 Kim et al.
6,995,406 B2 2/2006 Tojo et al.
7,010,183 B2 3/2006 Estes et al.
7,064,500 B2 6/2006 Victor et al.
7,068,948 B2 6/2006 Wei et al.
7,092,588 B2 8/2006 Kondo
7,092,603 B2 8/2006 Glebov et al.
7,099,586 B2 8/2006 Yoo
7,120,332 B1 10/2006 Spoonhower et al.
7,122,978 B2 10/2006 Nakanishi et al.
7,130,102 B2 10/2006 Rabinowitz
7,177,515 B2 2/2007 Estes et al.
7,194,798 B2 3/2007 Bonhote et al.
7,230,201 B1 6/2007 Miley et al.
7,253,426 B2 8/2007 Gorrell et al.
7,267,459 B2 9/2007 Matheson
7,267,461 B2 9/2007 Kan et al.
7,309,953 B2 12/2007 Tiberi et al.
7,342,441 B2 3/2008 Gorrell et al.
7,359,589 B2 4/2008 Gorrell et al.
7,361,916 B2 4/2008 Gorrell et al.
7,362,972 B2 4/2008 Yavor et al.
7,375,631 B2 5/2008 Moskowitz et al.
7,436,177 B2 10/2008 Gorrell et al.
7,442,940 B2 10/2008 Gorrell et al.
7,443,358 B2 10/2008 Gorrell et al.
7,459,099 B2 12/2008 Kubena et al.
7,470,920 B2 12/2008 Gorrell et al.
7,473,917 B2 1/2009 Singh
7,554,083 B2 6/2009 Gorrell et al.
7,569,836 B2 8/2009 Gorrell
7,573,045 B2 8/2009 Gorrell et al.
7,586,097 B2 9/2009 Gorrell et al.
7,586,167 B2 9/2009 Gorrell et al.
7,728,702 B2 6/2010 Gorrell
2001/0002315 A1 5/2001 Schultz et al.
2001/0025925 A1 10/2001 Abe et al.
2001/0045360 A1 11/2001 Omasa
2002/0009723 A1 1/2002 Hefti
2002/0027481 A1 3/2002 Fiedziuszko
2002/0036121 A1 3/2002 Ball et al.
2002/0036264 A1 3/2002 Nakasuji et al.
2002/0053638 A1 5/2002 Winkler et al.
2002/0056645 A1 5/2002 Taylor et al.
2002/0068018 A1 6/2002 Pepper et al.
2002/0070671 A1 6/2002 Small
2002/0071457 A1 6/2002 Hogan
2002/0122531 A1 9/2002 Whitham
2002/0135665 A1 9/2002 Gardner
2002/0139961 A1 10/2002 Kinoshita et al.
2002/0158295 A1 10/2002 Armgarth et al.
2002/0191650 A1 12/2002 Madey et al.
2003/0010979 A1 1/2003 Pardo
2003/0012925 A1 1/2003 Gorrell
2003/0016421 A1 1/2003 Small
2003/0034535 A1 2/2003 Barenburu et al.
2003/0103150 A1 6/2003 Catrysse et al.
2003/0106998 A1 6/2003 Colbert et al.
2003/0155521 A1 8/2003 Feuerbaum
2003/0158474 A1 8/2003 Scherer et al.
2003/0164947 A1 9/2003 Vaupel
2003/0179974 A1 9/2003 Estes et al.
2003/0206708 A1 11/2003 Estes
2003/0214695 A1 11/2003 Abramson et al.
2003/0222579 A1 12/2003 Habib et al.
2004/0011432 A1 1/2004 Podlaha et al.
2004/0061053 A1 4/2004 Taniguchi et al.
2004/0080285 A1 4/2004 Victor et al.
2004/0085159 A1 5/2004 Kubena et al.
2004/0092104 A1 5/2004 Gunn, III et al.
2004/0108471 A1 6/2004 Luo et al.
2004/0108473 A1 6/2004 Melnychuk et al.
2004/0108823 A1 6/2004 Amaldi et al.
2004/0136715 A1 7/2004 Kondo
2004/0150991 A1 8/2004 Ouderkirk et al.
2004/0154925 A1 8/2004 Podlaha et al.
2004/0171272 A1 9/2004 Jin et al.
2004/0180244 A1 9/2004 Tour et al.
2004/0184270 A1 9/2004 Halter
2004/0213375 A1* 10/2004 Bjorkholm et al. ..... 378/58
2004/0217297 A1 11/2004 Moses et al.
2004/0218651 A1 11/2004 Iwasaki et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0045832 A1 3/2005 Kelly et al.
2005/0054151 A1 3/2005 Lowther et al.
2005/0062903 A1 3/2005 Cok et al.
2005/0067286 A1 3/2005 Ahn et al.
2005/0082469 A1 4/2005 Carlo
2005/0092929 A1 5/2005 Schneiker
2005/0104684 A1 5/2005 Wojcik
2005/0105595 A1 5/2005 Martin et al.
2005/0105690 A1 5/2005 Pau et al.
2005/0145882 A1 7/2005 Taylor et al.
2005/0152635 A1 7/2005 Paddon et al.
2005/0162104 A1 7/2005 Victor et al.
2005/0180678 A1 8/2005 Panepucci et al.
2005/0190637 A1 9/2005 Ichimura et al.
2005/0191055 A1 9/2005 Maruyama et al.
2005/0194258 A1 9/2005 Cohen et al.
2005/0201707 A1 9/2005 Glebov et al.
2005/0201717 A1 9/2005 Matsumura
2005/0206314 A1 9/2005 Habib et al.
2005/0212503 A1 9/2005 Deibele
2005/0231138 A1 10/2005 Nakanishi et al.
2005/0249451 A1 11/2005 Baehr-Jones et al.
2005/0285541 A1 12/2005 LeChevalier
2006/0007730 A1 1/2006 Nakamura et al.
2006/0018619 A1 1/2006 Helffrich et al.
2006/0035173 A1 2/2006 Davidson et al.
2006/0045418 A1 3/2006 Cho et al.
2006/0050269 A1 3/2006 Brownell
2006/0060782 A1 3/2006 Khursheed
2006/0062258 A1 3/2006 Brau et al.
2006/0131176 A1 6/2006 Hsu
2006/0131695 A1 6/2006 Kuekes et al.
2006/0159131 A1 7/2006 Liu et al.
2006/0164496 A1 7/2006 Tokutake et al.
2006/0187794 A1 8/2006 Harvey et al.
2006/0208667 A1 9/2006 Lys et al.
2006/0216940 A1 9/2006 Gorrell et al.
2006/0232364 A1 10/2006 Koh et al.
2006/0243925 A1 11/2006 Barker et al.
2006/0274922 A1 12/2006 Ragsdale
2007/0003781 A1 1/2007 de Rochemont
2007/0013765 A1 1/2007 Hudson et al.
2007/0075263 A1 4/2007 Gorrell et al.
2007/0075264 A1 4/2007 Gorrell et al.
2007/0085039 A1 4/2007 Gorrell et al.
2007/0086915 A1 4/2007 LeBoeuf et al.
2007/0116420 A1 5/2007 Estes et al.
2007/0146704 A1 6/2007 Schmidt et al.
2007/0152176 A1 7/2007 Gorrell et al.

| | | | |
|---|---|---|---|
| 2007/0154846 | A1 | 7/2007 | Gorrell et al. |
| 2007/0194357 | A1 | 8/2007 | Oohashi |
| 2007/0200940 | A1 | 8/2007 | Gruhlke et al. |
| 2007/0238037 | A1 | 10/2007 | Wuister et al. |
| 2007/0252983 | A1 | 11/2007 | Tong et al. |
| 2007/0258492 | A1 | 11/2007 | Gorrell |
| 2007/0258689 | A1 | 11/2007 | Gorrell et al. |
| 2007/0258690 | A1 | 11/2007 | Gorrell et al. |
| 2007/0258720 | A1 | 11/2007 | Gorrell et al. |
| 2007/0259641 | A1 | 11/2007 | Gorrell |
| 2007/0264023 | A1 | 11/2007 | Gorrell et al. |
| 2007/0264030 | A1 | 11/2007 | Gorrell et al. |
| 2007/0282030 | A1 | 12/2007 | Anderson et al. |
| 2007/0284527 | A1 | 12/2007 | Zani et al. |
| 2008/0069509 | A1 | 3/2008 | Gorrell et al. |
| 2008/0218102 | A1 | 9/2008 | Sliski et al. |
| 2008/0283501 | A1 | 11/2008 | Roy |
| 2008/0302963 | A1 | 12/2008 | Nakasuji et al. |

FOREIGN PATENT DOCUMENTS

| | | | |
|---|---|---|---|
| JP | 2004-32323 | A | 1/2004 |
| WO | WO 87/01873 | | 3/1987 |
| WO | WO 93/21663 | A1 | 10/1993 |
| WO | WO 98/21788 | | 5/1998 |
| WO | WO 00/72413 | | 11/2000 |
| WO | WO 02/25785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2005/098966 | | 10/2005 |
| WO | WO 2006/042239 | A2 | 4/2006 |
| WO | WO 2007/081389 | | 7/2007 |
| WO | WO 2007/081390 | | 7/2007 |
| WO | WO 2007/081391 | | 7/2007 |

OTHER PUBLICATIONS

J. C. Palais, "Fiber optic communications," Prentice Hall, New Jersey, 1998, pp. 156-158.

Search Report and Written Opinion mailed Dec. 20, 2007 in PCT Appln. No. PCT/US2006/022771.

Search Report and Written Opinion mailed Jan. 31, 2008 in PCT Appln. No. PCT/US2006/027427.

Search Report and Written Opinion mailed Jan. 8, 2008 in PCT Appln. No. PCT/US2006/028741.

Search Report and Written Opinion mailed Mar. 11, 2008 in PCT Appln. No. PCT/US2006/022679.

Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.

Markoff, John, "A Chip That Can Transfer Data Using Laser Light," The New York Times, Sep. 18, 2006.

S.M. Sze, "Semiconductor Devices Physics and Technology", 2nd Edition, Chapters 9 and 12, Copyright 1985, 2002.

Search Report and Written Opinion mailed Feb. 12, 2007 in PCT Appln. No. PCT/US2006/022682.

Search Report and Written Opinion mailed Feb. 20, 2007 in PCT Appln. No. PCT/US2006/022676.

Search Report and Written Opinion mailed Feb. 20, 2007 in PCT Appln. No. PCT/US2006/022772.

Search Report and Written Opinion mailed Feb. 20, 2007 in PCT Appln. No. PCT/US2006/022780.

Search Report and Written Opinion mailed Feb. 21, 2007 in PCT Appln. No. PCT/US2006/022684.

Search Report and Written Opinion mailed Jan. 17, 2007 in PCT Appln. No. PCT/US2006/022777.

Search Report and Written Opinion mailed Jan. 23, 2007 in PCT Appln. No. PCT/US2006/022781.

Search Report and Written Opinion mailed Mar. 7, 2007 in PCT Appln. No. PCT/US2006/022775.

Speller et al., "A Low-Noise MEMS Accelerometer for Unattended Ground Sensor Applications", Applied MEMS Inc., 12200 Parc Crest, Stafford, TX, USA 77477.

Thurn-Albrecht et al., "Ultrahigh-Density Nanowire Arrays Grown in Self-Assembled Diblock Copolymer Templates", Science 290. 5499, Dec. 15, 2000, pp. 2126-2129.

"An Early History—Invention of the Klystron," http://varianinc.com/cgi-bin/advprint/print.cgi?cid=KLQNPPJJFJ, printed on Dec. 26, 2008.

"An Early History—The Founding of Varian Associates," http://varianinc.com/cgi-bin/advprint/print.cgi?cid=KLQNPPJJFJ, printed on Dec. 26, 2008.

"Chapter 3 X-Ray Tube," http://compepid.tuskegee.edu/syllabi/clinical/small/radiology/chapter . . . , printed from tuskegee.edu on Dec. 29, 2008.

"Diagnostic imaging modalities—Ionizing vs non-ionizing radiation," http://info.med.yale.edu/intmed/cardio/imaging/techniques/ionizing_v . . . , printed from Yale University School of Medicine on Dec. 29, 2008.

"Frequently Asked Questions," Luxtera Inc., found at http://www.luxtera.com/technology_faq.htm, printed on Dec. 2, 2005, 4 pages.

"Klystron Amplifier," http://www.radartutorial.eu/08.transmitters/tx12.en.html, printed on Dec. 26, 2008.

"Klystron is a Micowave Generator," http://www2.slac.stanford.edu/vvc/accelerators/klystron.html, printed on Dec. 26, 2008.

"Klystron," http:en.wikipedia.org/wiki/Klystron, printed on Dec. 26, 2008.

"Making X-rays," http://www.fnrfscience.cmu.ac.th/theory/radiation/xray-basics.html, printed on Dec. 29, 2008.

"Microwave Tubes," http://www.tpub.com/neets/book11/45b.htm, printed on Dec. 26, 2008.

"Notice of Allowability" mailed on Jan. 17, 2008 in U.S. Appl. No. 11/418,082, filed May 5, 2006.

"Technology Overview," Luxtera, Inc., found at http://www.luxtera.com/technology.htm, printed on Dec. 2, 2005, 1 page.

"The Reflex Klystron," http://www.fnrfscience.cmu.ac.th/theory/microwave/microwave%2, printed from Fast Netoron Research Facilty on Dec. 26, 2008.

"X-ray tube," http://www.answers.com/topic/x-ray-tube, printed on Dec. 29, 2008.

Mar. 6, 2009 Response to PTO Office Action of Sep. 16, 2008 in U.S. Appl. No. 11/418,085.

Mar. 17, 2008 PTO Office Action in U.S. Appl. No. 11/353,208.

Mar. 19, 2009 PTO Office Action in U.S. Appl. No. 11/411,120.

Mar. 24, 2006 PTO Office Action in U.S. Appl. No. 10/917,511.

Mar. 25, 2008 PTO Office Action in U.S. Appl. No. 11/411,131.

Mar. 26, 2009 Response to PTO Office Action of Sep. 26, 2008 in U.S. Appl. No. 11/410,905.

Mar. 31, 2008 PTO Office Action in U.S. Appl. No. 11/418,315.

Apr. 8, 2008 PTO Office Action in U.S. Appl. No. 11/325,571.

Apr. 11, 2008 PTO Office Action in U.S. Appl. No. 11/418,079.

Apr. 17, 2008 Response to PTO Office Action of Dec. 20, 2007 in U.S. Appl. No. 11/418,087.

Apr. 19, 2007 Response to PTO Office Action of Jan. 17, 2007 in U.S. Appl. No. 11/418,082.

May 5, 2008 Response to PTO Office Action of Nov. 5, 2007 in U.S. Appl. No. 11/418,084.

May 10, 2005 PTO Office Action in U.S. Appl. No. 10/917,511.

May 21, 2007 PTO Office Action in U.S. Appl. No. 11/418,087.

May 26, 2006 Response to PTO Office Action of Mar. 24, 2006 in U.S. Appl. No. 10/917,511.

Jun. 2, 2008 PTO Office Action in U.S. Appl. No. 11/418,097.

Jun. 11, 2008 PTO Office Action in U.S. Appl. No. 11/325,534.

Jun. 16, 2008 Response to PTO Office Action of Dec. 14, 2007 in U.S. Appl. No. 11/418,264.

Jun. 20, 2008 PTO Office Action in U.S. Appl. No. 11/418,083.

Jun. 20, 2008 Response to PTO Office Action of Mar. 25, 2008 in U.S. Appl. No. 11/411,131.

Jul. 1, 2008 PTO Office Action in U.S. Appl. No. 11/418,244.

Jul. 30, 2007 PTO Office Action in U.S. Appl. No. 11/418,091.

Aug. 10, 2007 PTO Office Action in U.S. Appl. No. 11/418,085.

Aug. 12, 2008 Response to PTO Office Action of Feb. 12, 2008 in U.S. Appl. No. 11/418,085.

Aug. 14, 2006 PTO Office Action in U.S. Appl. No. 10/917,511.

Aug. 19, 2008 PTO Office Action in U.S. Appl. No. 11/418,084.

Sep. 1, 2006 Response to PTO Office Action of Aug. 14, 2006 in U.S. Appl. No. 10/917,511.
Sep. 12, 2005 Response to PTO Office Action of May 10, 2005 in U.S. Appl. No. 10/917,511.
Sep. 14, 2007 PTO Office Action in U.S. Appl. No. 11/411,131.
Sep. 15, 2008 Response to PTO Office Action of Mar. 17, 2008 in U.S. Appl. No. 11/353,208.
Sep. 16, 2008 PTO Office Action in U.S. Appl. No. 11/418,085.
Sep. 26, 2008 PTO Office Action in U.S. Appl. No. 11/410,905.
Oct. 7, 2008 Response to PTO Office Action of Apr. 11, 2008 in U.S. Appl. No. 11/418,079.
Oct. 15, 2008 Response to PTO Office Action of Jun. 11, 2008 in U.S. Appl. No. 11/325,534.
Oct. 16, 2008 PTO Office Action in U.S. Appl. No. 11/400,280.
Oct. 19, 2007 Response to PTO Office Action of May 21, 2007 in U.S. Appl. No. 11/418,087.
Oct. 24, 2008 Response to PTO Office Action of Oct. 16, 2008 in U.S. Appl. No. 11/400,280.
Nov. 5, 2007 PTO Office Action in U.S. Appl. No. 11/418,084.
Nov. 13, 2007 Response to PTO Office Action of Aug. 10, 2007 in U.S. Appl. No. 11/418,085.
Nov. 25, 2008 Response to PTO Office Action of Jul. 1, 2008 in U.S. Appl. No. 11/418,244.
Nov. 27, 2007 Response to PTO Office Action of Jul. 30, 2007 in U.S. Appl. No. 11/418,091.
Dec. 2, 2008 Response to PTO Office Action of Jun. 2, 2008 in U.S. Appl. No. 11/418,097.
Dec. 4, 2006 PTO Office Action in U.S. Appl. No. 11/418,087.
Dec. 14, 2007 PTO Office Action in U.S. Appl. No. 11/418,264.
Dec. 14, 2007 Response to PTO Office Action of Sep. 14, 2007 in U.S. Appl. No. 11/411,131.
Dec. 18, 2008 Response to PTO Office Action of Jun. 20, 2008 in U.S. Appl. No. 11/418,083.
Dec. 20, 2007 PTO Office Action in U.S. Appl. No. 11/418,087.
Dec. 24, 2008 PTO Office Action in U.S. Appl. No. 11/353,208.
Corcoran, Elizabeth, "Ride the Light," Forbes Magazine, Apr. 11, 2005, pp. 68-70.
European Search Report mailed Mar. 3, 2009 in European Application No. 06852028.7.
Neo et al., "Smith-Purcell Radiation from Ultraviolet to Infrared Using a Si-field Emitter" Vacuum Electronics Conference, 2007, IVEC '07, IEEE International May 2007.
Saraph, Girish P. et al., "Design of a Single-Stage Depressed Collector for High-Power, Pulsed Gyroklystrom Amplifiers," IEEE Transactions on Electron Devices, vol. 45, No. 4, Apr. 1998, pp. 986-990.
Sartori, Gabriele, "CMOS Photonics Platform," Luxtera, Inc., Nov. 2005, 19 pages.
Search Report and Writen Opinion mailed Jul. 14, 2008 in PCT Appln. No. PCT/US2006/022773.
Search Report and Written Opinion mailed Aug. 19, 2008 in PCT Appln. No. PCT/US2007/008363.
Search Report and Written Opinion mailed Jul. 16, 2008 in PCT Appln. No. PCT/US2006/022766.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Sep. 2, 2008 in PCT Appln. No. PCT/US2006/022769.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.
U.S. Appl. No. 11/203,407—Nov. 13, 2008 PTO Office Action.
U.S. Appl. No. 11/238,991—Dec. 6, 2006 PTO Office Action.
U.S. Appl. No. 11/238,991—Jun. 6, 2007 Response to PTO Office Action of Dec. 6, 2006.
U.S. Appl. No. 11/238,991—Sep. 10, 2007 PTO Office Action.
U.S. Appl. No. 11/238,991—Mar. 6, 2008 Response to PTO Office Action of Sep. 10, 2007.
U.S. Appl. No. 11/238,991—Jun. 27, 2008 PTO Office Action.
U.S. Appl. No. 11/238,991—Dec. 29, 2008 Response to PTO Office Action of Jun. 27, 2008.
U.S. Appl. No. 11/238,991—Mar. 24, 2009 PTO Office Action.
U.S. Appl. No. 11/243,477—Apr. 25, 2008 PTO Office Action.
U.S. Appl. No. 11/243,477—Oct. 24, 2008 Response to PTO Office Action of Apr. 25, 2008.
U.S. Appl. No. 11/243,477—Jan. 7, 2009 PTO Office Action.
U.S. Appl. No. 11/325,448—Jun. 16, 2008 PTO Office Action.
U.S. Appl. No. 11/325,448—Dec. 16, 2008 Response to PTO Office Action of Jun. 16, 2008.
U.S. Appl. No. 11/353,208—Jan. 15, 2008 PTO Office Action.
U.S. Appl. No. 11/353,208—Dec. 30, 2008 Response to PTO Office Action of Dec. 24, 2008.
U.S. Appl. No. 11/410,924—Mar. 6, 2009 PTO Office Action.
U.S. Appl. No. 11/411,129—Jan. 16, 2009 Office Action.
U.S. Appl. No. 11/411,130—May 1, 2008 PTO Office Action.
U.S. Appl. No. 11/411,130—Oct. 29, 2008 Response to PTO Office Action of May 1, 2008.
U.S. Appl. No. 11/417,129—Jul. 11, 2007 PTO Office Action.
U.S. Appl. No. 11/417,129—Dec. 12, 2007 Response to PTO Office Action of Jul. 11, 2007.
U.S. Appl. No. 11/417,129—Dec. 20, 2007 Response to PTO Office Action of Jul. 11, 2007.
U.S. Appl. No. 11/417,129—Apr. 17, 2008 PTO Office Action.
U.S. Appl. No. 11/417,129—Jun. 19, 2008 Response to PTO Office Action of Apr. 17, 2008.
U.S. Appl. No. 11/418,079—Feb. 12, 2009 PTO Office Action.
U.S. Appl. No. 11/418,080—Mar. 18, 2009 PTO Office Action.
U.S. Appl. No. 11/418,082—Jan. 17, 2007 PTO Office Action.
U.S. Appl. No. 11/418,084—Feb. 19, 2009 Response to PTO Office Action of Aug. 19, 2008.
U.S. Appl. No. 11/418,085—Feb. 12, 2008 PTO Office Action.
U.S. Appl. No. 11/418,087—Dec. 29, 2006 Response to PTO Office Action of Dec. 4, 2006.
U.S. Appl. No. 11/418,087—Feb. 15, 2007 PTO Office Action.
U.S. Appl. No. 11/418,087—Mar. 6, 2007 Response to PTO Office Action of Feb. 15, 2007.
U.S. Appl. No. 11/418,088—Jun. 9, 2008 PTO Office Action.
U.S. Appl. No. 11/418,088—Dec. 8, 2008 Response to PTO Office Action of Jun. 9, 2008.
U.S. Appl. No. 11/418,089—Mar. 21, 2008 PTO Office Action.
U.S. Appl. No. 11/418,089—Jun. 23, 2008 Response to PTO Office Action of Mar. 21, 2008.
U.S. Appl. No. 11/418,089—Sep. 30, 2008 PTO Office Action.
U.S. Appl. No. 11/418,089—Mar. 30, 2009 Response to PTO Office Action of Sep. 30, 2008.
U.S. Appl. No. 11/418,091—Feb. 26, 2008 PTO Office Action.
U.S. Appl. No. 11/418,097—Feb. 18, 2009 PTO Office Action.
U.S. Appl. No. 11/418,099—Jun. 23, 2008 PTO Office Action.
U.S. Appl. No. 11/418,099—Dec. 23, 2008 Response to PTO Office Action of Jun. 23, 2008.
U.S. Appl. No. 11/418,100—Jan. 12, 2009 PTO Office Action.
U.S. Appl. No. 11/418,123—Apr. 25, 2008 PTO Office Action.
U.S. Appl. No. 11/418,123—Oct. 27, 2008 Response to PTO Office Action of Apr. 25, 2008.
U.S. Appl. No. 11/418,123—Jan. 26, 2009 PTO Office Action.
U.S. Appl. No. 11/418,124—Oct. 1, 2008 PTO Office Action.
U.S. Appl. No. 11/418,124—Feb. 2, 2009 Response to PTO Office Action of Oct. 1, 2008.
U.S. Appl. No. 11/418,124—Mar. 13, 2009 PTO Office Action.
U.S. Appl. No. 11/418,126—Oct. 12, 2006 PTO Office Action.
U.S. Appl. No. 11/418,126—Feb. 12, 2007 Response to PTO Office Action of Oct. 12, 2006 (Redacted).
U.S. Appl. No. 11/418,126—Jun. 6, 2007 PTO Office Action.
U.S. Appl. No. 11/418,126—Aug. 6, 2007 Response to PTO Office Action of Jun. 6, 2007.
U.S. Appl. No. 11/418,126—Nov. 2, 2007 PTO Office Action.
U.S. Appl. No. 11/418,126—Feb. 22, 2008 Response to PTO Office Action of Nov. 2, 2007.

U.S. Appl. No. 11/418,126—Jun. 10, 2008 PTO Office Action.
U.S. Appl. No. 11/418,127—Apr. 2, 2009 Office Action.
U.S. Appl. No. 11/418,128—Dec. 16, 2008 PTO Office Action.
U.S. Appl. No. 11/418,128—Dec. 31, 2008 Response to PTO Office Action of Dec. 16, 2008.
U.S. Appl. No. 11/418,128—Feb. 17, 2009 PTO Office Action.
U.S. Appl. No. 11/418,129—Dec. 16, 2008 Office Action.
U.S. Appl. No. 11/418,129—Dec. 31, 2008 Response to PTO Office Action of Dec. 16, 2008.
U.S. Appl. No. 11/418,263—Sep. 24, 2008 PTO Office Action.
U.S. Appl. No. 11/418,263—Dec. 24, 2008 Response to PTO Office Action of Sep. 24, 2008.
U.S. Appl. No. 11/418,263—Mar. 9, 2009 PTO Office Action.
U.S. Appl. No. 11/418,318—Mar. 31, 2009 PTO Office Action.
U.S. Appl. No. 11/441,219—Jan. 7, 2009 PTO Office Action.
U.S. Appl. No. 11/522,929—Oct. 22, 2007 PTO Office Action.
U.S. Appl. No. 11/522,929—Feb. 21, 2008 Response to PTO Office Action of Oct. 22, 2007.
U.S. Appl. No. 11/641,678—Jul. 22, 2008 PTO Office Action.
U.S. Appl. No. 11/641,678—Jan. 22, 2009 Response to Office Action of Jul. 22, 2008.
U.S. Appl. No. 11/711,000—Mar. 6, 2009 PTO Office Action.
U.S. Appl. No. 11/716,552—Feb. 12, 2009 Response to PTO Office Action of Feb. 9, 2009.
U.S. Appl. No. 11/716,552—Jul. 3, 2008 PTO Office Action.
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Jun. 18, 2008 in PCT Appln. No. PCT/U S2006/027430.
Search Report and Written Opinion mailed Jun. 3, 2008 in PCT Appln. No. PCT/US2006/022783.
Search Report and Written Opinion mailed Mar. 24, 2008 in PCT Appln. No. PCT/US2006/022677.
Search Report and Written Opinion mailed Mar. 24, 2008 in PCT Appln. No. PCT/U S2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
"Array of Nanoklystrons for Frequency Agility or Redundancy," NASA's Jet Propulsion Laboratory, NASA Tech Briefs, NPO-21033. 2001.
"Antenna Arrays." May 18, 2002. www.tpub.com/content/neets/14183/css/14183_159.htm.
Alford, T.L. et al., "Advanced silver-based metallization patterning for ULSI applications," Microelectronic Engineering 55, 2001, pp. 383-388, Elsevier Science B.V.
Amato, Ivan, "An Everyman's Free-Electron Laser?" Science, New Series, Oct. 16, 1992, p. 401, vol. 258 No. 5081, American Association for the Advancement of Science.
Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.
Bakhtyari, A. et al., "Horn Resonator Boosts Miniature Free-Electron Laser Power," Applied Physics Letters, May 12, 2003, pp. 3150-3152, vol. 82, No. 19, American Institute of Physics.
Bhattacharjee, Sudeep et al., "Folded Waveguide Traveling—Wave Tube Sources for Terahertz Radiation." IEEE Transactions on Plasma Science, vol. 32. No. 3, Jun. 2004, pp. 1002-1014.
Brau, C.A. et al., "Gain and Coherent Radiation from a Smith-Purcell Free Electron Laser," Proceedings of the 2004 FEL Conference, pp. 278-281.
Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.
Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.
Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.
Chuang, S.L. et al., "Smith-Purcell Radiation from a Charge Moving Above a Penetrable Grating," IEEE MTT-S Digest, 1983, pp. 405-406, IEEE.
Far-IR, Sub-MM & MM Detector Technology Workshop list of manuscripts, session 6 2002.
Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.
Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.
Gallerano, G.P. et al., "Overview of Terahertz Radiation Sources," Proceedings of the 2004 FEL Conference, pp. 216-221.
Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.
Gover, A. et al., "Angular Radiation Pattern of Smith-Purcell Radiation," Journal of the Optical Society of America, Oct. 1984, pp. 723-728, vol. 1 No. 5, Optical Society of America.
Grishin, Yu. A. et al., "Pulsed Orotron—A New Microwave Source for Submillimeter Pulse High-Field Electron Paramagnetic Resonance Spectroscopy," Review of Scientific Instruments, Sep. 2004, pp. 2926-2936, vol. 75 No. 9, American Institute of Physics.
Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.
Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.
Ives, Lawrence et al., "Development of Backward Wave Oscillators for Terahertz Applications," Terahertz for Military and Security Applications, Proceedings of SPIE vol. 5070 (2003), pp. 71-82.
Ives, R. Lawrence, "IVEC Summary, Session 2, Sources I" 2002.
Jonietz, Erika, "Nano Antenna Gold nanospheres show path to all-optical computing," Technology Review, Dec. 2005/Jan. 2006, p. 32.
Joo, Youngcheol et al., "Air Cooling of IC Chip with Novel Microchannels Monolithically Formed on Chip Front Surface," Cooling and Thermal Design of Electronic Systems (HTD—vol. 319 & EEP—vol. 15), International Mechanical Engineering Congress and Exposition, San Francisco, CA Nov. 1995 pp. 117-121.
Joo, Youngcheol et al., "Fabrication of Monolithic Microchannels for IC Chip Cooling," 1995, Mechanical, Aerospace and Nuclear Engineering Department, University of California at Los Angeles.
Jung, K.B. et al., "Patterning of Cu, Co, Fe, and Ag for magnetic nanostructures," J. Vac. Sci. Technol. A 15(3), May/Jun. 1997, pp. 1780-1784.
Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.
Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.
Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.
Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.
Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.

McDaniel, James C. et al., "Smith-Purcell Radiation in the High Conductivity and Plasma Frequency Limits," Applied Optics, Nov. 15, 1989, pp. 4924-4929, vol. 28 No. 22, Optical Society of America.
Meyer, Stephan, "Far IR, Sub-MM & MM Detector Technology Workshop Summary," Oct. 2002. (may date the Manohara documents).
Mokhoff, Nicolas, "Optical-speed light detector promises fast space talk," EETimes Online, Mar. 20, 2006, from website: www.eetimes.com/showArticle.jhtml?articleID=183701047.
Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.
Nguyen, Phucanh et al., "Reactive ion etch of patterned and blanket silver thin films in Cl2/O2 and O2 glow discharges," J. Vac. Sci, Technol. B. 17 (5), Sep./Oct. 1999, American Vacuum Society, pp. 2204-2209.
Phototonics Research, "Surface-Plasmon-Enhanced Random Laser Demonstrated," Phototonics Spectra, Feb. 2005, pp. 112-113.
Potylitsin, A.P., "Resonant Diffraction Radiation and Smith-Purcell Effect," (Abstract), arXiv: physics/9803043 v2 Apr. 13, 1998.
Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1989, pp. 3267-3269, vol. 65 No. 8, American Institute of Physics.
Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7 No. 5, Optical Society of America.
Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7 No. 3, Optical Society of America.
Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.
Search Report and Written Opinion mailed Sep. 17, 2007 in PCT Appln. No. PCT/US2006/022689.
International Search Report and Written Opinion mailed Nov. 23, 2007 in International Application No. PCT/US2006/022786.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.
"Notice of Allowability" mailed on Jul. 2, 2009 in U.S. Appl. No. 11/410,905, filed Apr. 26, 2006.
"Notice of Allowability" mailed on Jun. 30, 2009 in U.S. Appl. No. 11/418,084, filed May 5, 2006.
B. B Loechel et al., "Fabrication of Magnetic Microstructures by Using Thick Layer Resists", Microelectronics Eng., vol. 21, pp. 463-466 (1993).
Response to Non-Final Office Action submitted May 13, 2009 in U.S. Appl. No. 11/203,407.
U.S. Appl. No. 11/238,991—May 11, 2009 PTO Office Action.
U.S. Appl. No. 11/350,812—Apr. 17, 2009 Office Action.
U.S. Appl. No. 11/411,130—Jun. 23, 2009 PTO Office Action.
U.S. Appl. No. 11/418,089—Jul. 15, 2009 PTO Office Action.
U.S. Appl. No. 11/433,486—Jun. 19, 2009 PTO Office Action.
Brau et al., "Tribute to John E Walsh", Nuclear Instruments and Methods in Physics Research Section A. Accelerators, Spectrometers, Detectors and Associated Equipment, vol. 475, Issues 1-3, Dec. 21, 2001, pp. xiii-xiv.
Kapp, et al., "Modification of a scanning electron microscope to produce Smith-Purcell radiation", Rev. Sci. Instrum. 75, 4732 (2004).
Scherer et al. "Photonic Crystals for Confining, Guiding, and Emitting Light", IEEE Transactions on Nanotechnology, vol. 1, No. 1, Mar. 2002, pp. 4-11.
U.S. Appl. No. 11/203,407—Jul. 17, 2009 PTO Office Action.
U.S. Appl. No. 11/418,097—Sep. 16, 2009 PTO Office Action.
U.S. Appl. No. 11/418,123—Aug. 11, 2009 PTO Office Action.
U.S. Appl. No. 11/418,365—Jul. 23, 2009 PTO Office Action.
U.S. Appl. No. 11/441,240—Aug. 31, 2009 PTO Office Action.
Urata et al., "Superradiant Smith-Purcell Emission", Phys. Rev. Lett. 80, 516-519 (1998).
European Search Report mailed Nov. 2, 2009 (related to PCT/US2006/022782).
Gervasoni J.L. et al., "Plasmon Excitations in Cylindrical Wires by External Charged Particles," Physical Review B (Condensed Matter and Materials Physics) APS through AIP USA, vol. 68, No. 23, Dec. 15, 2003, pp. 235302-1, XP002548423, ISSN: 0163-1829.
Gervasoni, J.L., "Excitations of Bulk and Surface Plasmons in Solids and Nanostructures," Surface and Interface Analysis, Apr. 2006, John Wiley and Sons Ltd GB, vol. 38, No. 4, Apr. 2006, pp. 583-586, XP002548422.
U.S. Appl. No. 11/418,128—Nov. 24, 2009 PTO Office Action.
U.S. Appl. No. 11/418,263—Dec. 9, 2009 PTO Office Action.
Bekefi et al., "Stimulated Raman Scattering by an Intense Relativistic Electron Beam Subjected to a Rippled Electron Field", Aug. 1979, J. Appl. Phys., 50(8), 5168-5164.

Kaplan et al.: "Extreme-Ultraviolet and X-ray. Emission and Amplification by Nonrelativistic Electron Beams Traversing a Superlattice" Applied Physics Letters, AIP, American Institute of Physics, Melville, NY LNKD—DOI: 10.1063/1.94869, vol. 44, No. 7, Apr. 1, 1984, pp. 661-663, XP000706537 ISSN: 0003-6951.
Rich, Alan, "Shielding and Guarding, How to Exclude Interference-type noise," Analog Dialogue 17-1, 1983.
Smith et al. "Enhanced Diffraction from a Grating on the Surface of a Negative-Index Metamaterial," Physical Review Letters, vol. 93, No. 13, 2004.
Supplementary European Search Report mailed Jul. 2, 2010 in EP Appin. No. 06772832.9.
Supplementary European Search Report mailed Jul. 5, 2010 in EP Appin. No. 06772830.3.
U.S. Appl. No. 11/411,129—Jan. 28, 2010 PTO Office Action.
U.S. Appl. No. 11/418,079—Jan. 7, 2010 PTO Office Action.
U.S. Appl. No. 11/418,080—Jan. 5, 2010 PTO Office Action.
U.S. Appl. No. 11/418,086—Mar. 4, 2010 PTO Office Action.
U.S. Appl. No. 11/418,318—Jun. 11, 2010 PTO Office Action.
U.S. Appl. No. 11/418,365—Feb. 23, 2010 PTO Office Action.
Extended European Search Report mailed Jun. 16, 2010 in Ep Appin. No. 06844144.3.
U.S. Appl. No. 11/418,079—Oct. 12, 2010 PTO Office Action.
U.S. Appl. No. 11/418,089—Oct. 1, 2010 PTO Office Action.
U.S. Appl. No. 11/418,318—Oct. 13, 2010 PTO Office Action.
U.S. Appl. No. 12/843,415—Oct. 13, 2010 PTO Office Action.

* cited by examiner

SELECTABLE FREQUENCY LIGHT EMITTER

CROSS-REFERENCE TO CO-PENDING APPLICATIONS

The present invention is related to the following co-pending U.S. patent applications: (1) U.S. patent application Ser. No. 11/238,991, filed Sep. 30, 2005, entitled "Ultra-Small Resonating Charged Particle Beam Modulator"; (2) U.S. patent application Ser. No. 10/917,511, filed on Aug. 13, 2004, entitled "Patterning Thin Metal Film by Dry Reactive Ion Etching"; (3) U.S. application Ser. No. 11/203,407, filed on Aug. 15, 2005, entitled "Method Of Patterning Ultra-Small Structures"; (4) U.S. application Ser. No. 11/243,476, filed on Oct. 5, 2005, entitled "Structures And Methods For Coupling Energy From An Electromagnetic Wave"; (5) U.S. application Ser. No. 11/243,477, filed on Oct. 5, 2005, entitled "Electron beam induced resonance,", (6) U.S. application Ser. No. 11/325,432, entitled "Resonant Structure-Based Display," filed on Jan. 5, 2006; (7) U.S. application Ser. No. 11/325,571, entitled "Switching Micro-Resonant Structures By Modulating A Beam Of Charged Particles," filed on Jan. 5, 2006; (8) U.S. application Ser. No. 11/325,534, entitled "Switching Micro-Resonant Structures Using At Least One Director," filed on Jan. 5, 2006; (9) U.S. application Ser. No. 11/350,812, entitled "Conductive Polymers for the Electroplating", filed on Feb. 10, 2006; and (10) U.S. application Ser. No. 11/325,448, entitled "Selectable Frequency Light Emitter", filed on Jan. 5, 2006, which are all commonly owned with the present application, the entire contents of each of which are incorporated herein by reference.

FIELD OF INVENTION

This relates to the production of electromagnetic radiation (EMR) at selected frequencies and to the coupling of high frequency electromagnetic radiation to elements on a chip or a circuit board.

INTRODUCTION

In the above-identified patent applications, the design and construction methods for ultra-small structures for producing electromagnetic radiation are disclosed. When the disclosed ultra-small structures are resonated by a passing charged particle beam, electromagnetic radiation having a predominant frequency is produced. In fact, the placement of multiple structures, each having different geometries, provides the possibility to actively select one of several predominant frequencies. (Other frequencies may also be generated, but by properly selecting the spacing between resonant structures and lengths of the structures, the desired frequency can be made predominant.)

It is possible to place plural resonant structures on a substrate and to selectively control which of the plural resonant structures, if any, is excited at a particular time.

BRIEF DESCRIPTION OF THE DRAWINGS

The following description, given with respect to the attached drawings, may be better understood with reference to the non-limiting examples of the drawings, wherein.

DISCUSSION OF THE PREFERRED EMBODIMENTS

Figure 1:
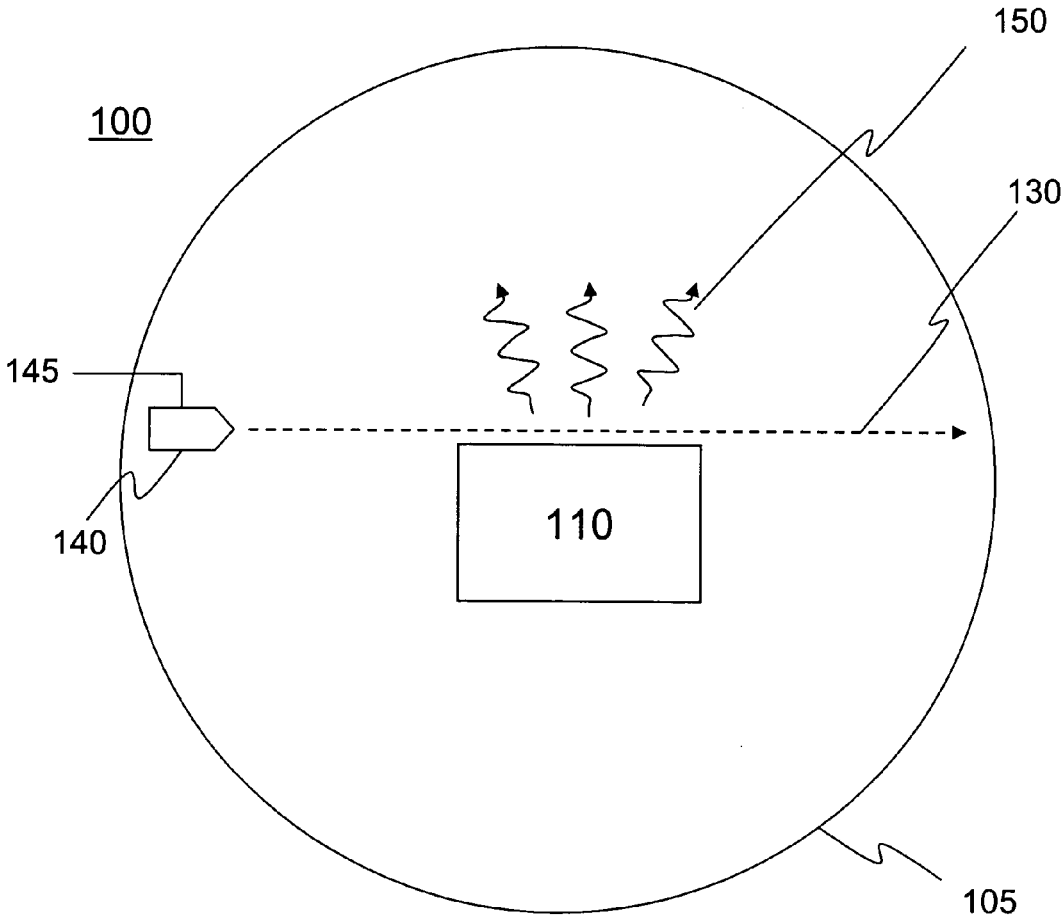
FIG. 1 is a generalized block diagram of a generalized resonant structure and its charged particle source.

Turning to FIG. 1, according to the present invention, a wavelength element 100 on a substrate 105 (such as a semiconductor substrate or a circuit board) can be produced from at least one resonant structure 110 that emits light (such as infrared light, visible light or ultraviolet light or any other electromagnetic radiation (EMR) 150 at a wide range of frequencies, and often at a frequency higher than that of microwave). The EMR 150 is emitted when the resonant structure 110 is exposed to a beam 130 of charged particles ejected from or emitted by a source of charged particles 140. The source 140 is controlled by applying a signal on data input 145. The source 140 can be any desired source of charged particles such as an electron gun, a cathode, an ion source, an electron source from a scanning electron microscope, etc.

Figure 2A:
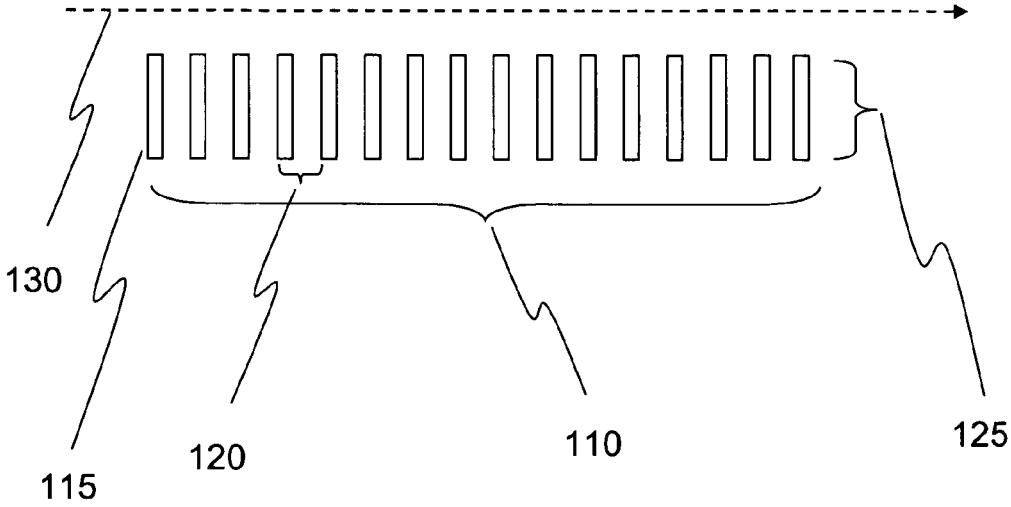
FIG. 2A is a top view of a non-limiting exemplary resonant structure for use with the present invention.

Exemplary resonant structures are illustrated in FIGS. 2A-2H. As shown in FIG. 2A, a resonant structure 110 may comprise a series of fingers 115 which are separated by a spacing 120 measured as the beginning of one finger 115 to the beginning of an adjacent finger 115. The finger 115 has a thickness that takes up a portion of the spacing between fingers 115. The fingers also have a length 125 and a height (not shown). As illustrated, the fingers of FIG. 2A are perpendicular to the beam 130.

Resonant structures 110 are fabricated from resonating material (e.g., from a conductor such as metal (e.g., silver, gold, aluminum and platinum or from an alloy) or from any other material that resonates in the presence of a charged particle beam). Other exemplary resonating materials include carbon nanotubes and high temperature superconductors.

When creating any of the elements 100 according to the present invention, the various resonant structures can be constructed in multiple layers of resonating materials but are preferably constructed in a single layer of resonating material (as described above).

In one single layer embodiment, all the resonant structures 110 of a wavelength element 100 are etched or otherwise shaped in the same processing step. In one multi-layer embodiment, the resonant structures 110 of each resonant frequency are etched or otherwise shaped in the same processing step. In yet another multi-layer embodiment, all resonant structures having segments of the same height are etched or otherwise shaped in the same processing step. In yet another embodiment, all of the resonant structures 110 on a substrate 105 are etched or otherwise shaped in the same processing step.

The material need not even be a contiguous layer, but can be a series of resonant structures individually present on a substrate. The materials making up the resonant elements can be produced by a variety of methods, such as by pulsed-plating, depositing, sputtering or etching. Preferred methods for doing so are described in co-pending U.S. application Ser. No. 10/917,571, filed on Aug. 13, 2004, entitled "Patterning Thin Metal Film by Dry Reactive Ion Etching," and in U.S. application Ser. No. 11/203,407, filed on Aug. 15, 2005, entitled "Method Of Patterning Ultra-Small Structures," both of which are commonly owned at the time of filing, and the entire contents of each of which are incorporated herein by reference.

At least in the case of silver, etching does not need to remove the material between segments or posts all the way down to the substrate level, nor does the plating have to place the posts directly on the substrate. Silver posts can be on a silver layer on top of the substrate. In fact, we discovered that, due to various coupling effects, better results are obtained when the silver posts are set on a silver layer, which itself is on the substrate.

Figure 2B:
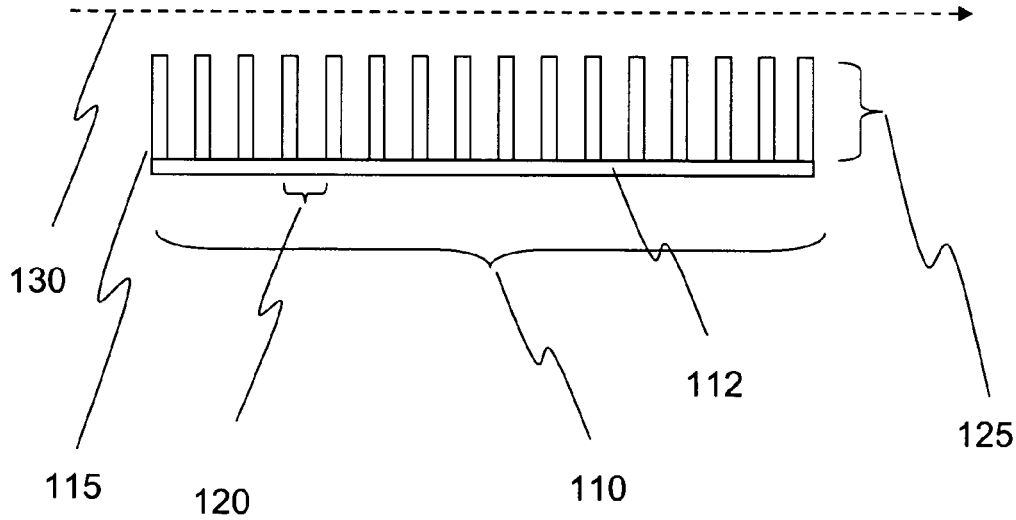
FIG. 2B is a top view of the exemplary resonant structure of FIG. 2A with the addition of a backbone.
Figure 2C:
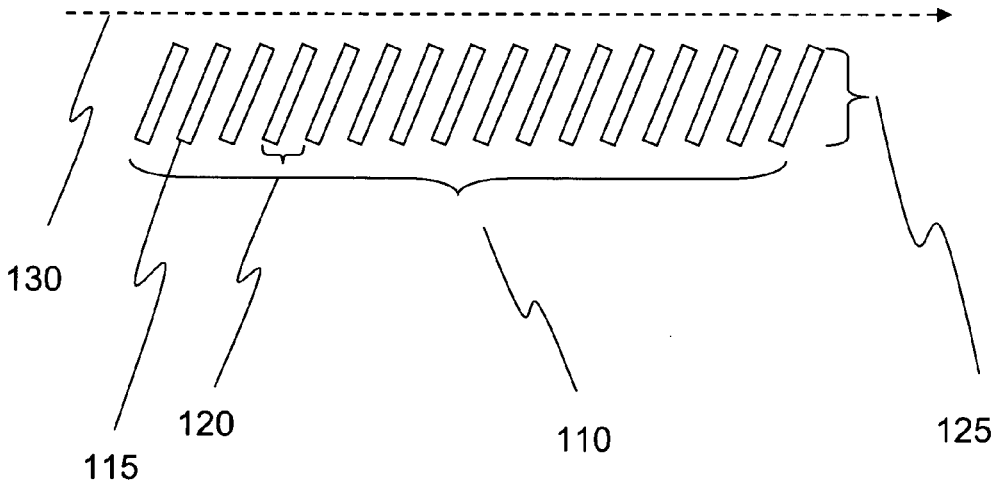
FIGS. 2C-2H are top views of other exemplary resonant structures for use with the present invention.
Figure 2D:
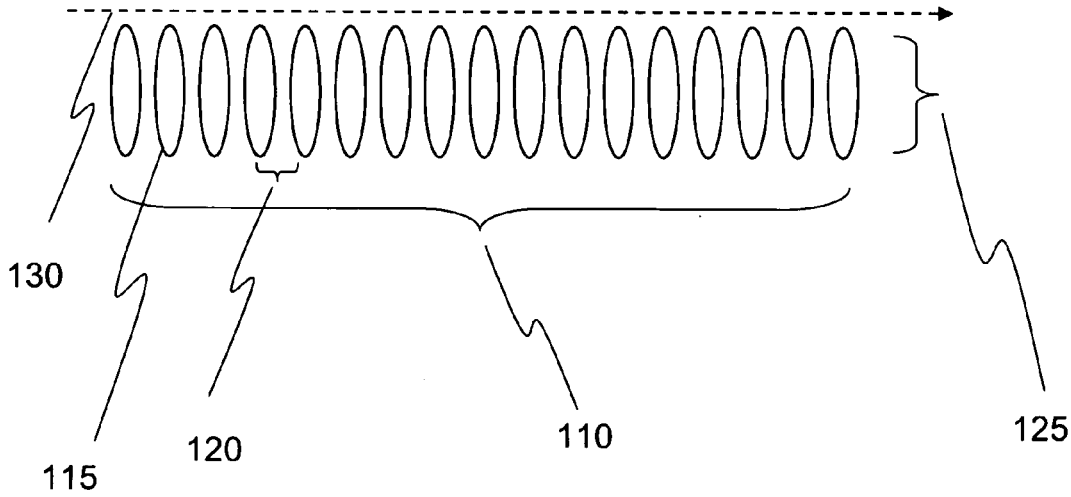
Figure 2E:
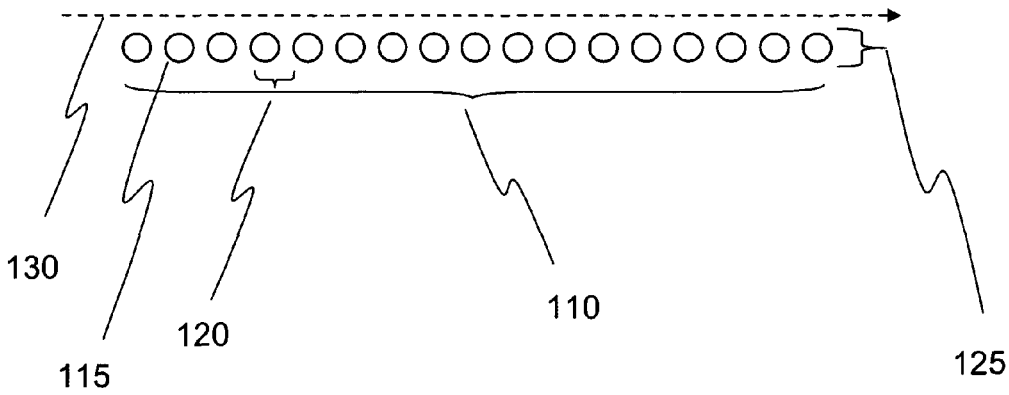
Figure 2F:
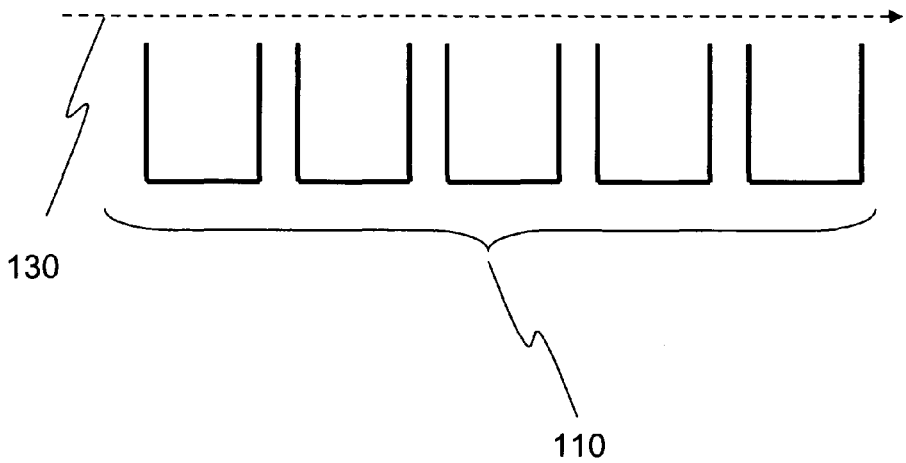
Figure 2G:
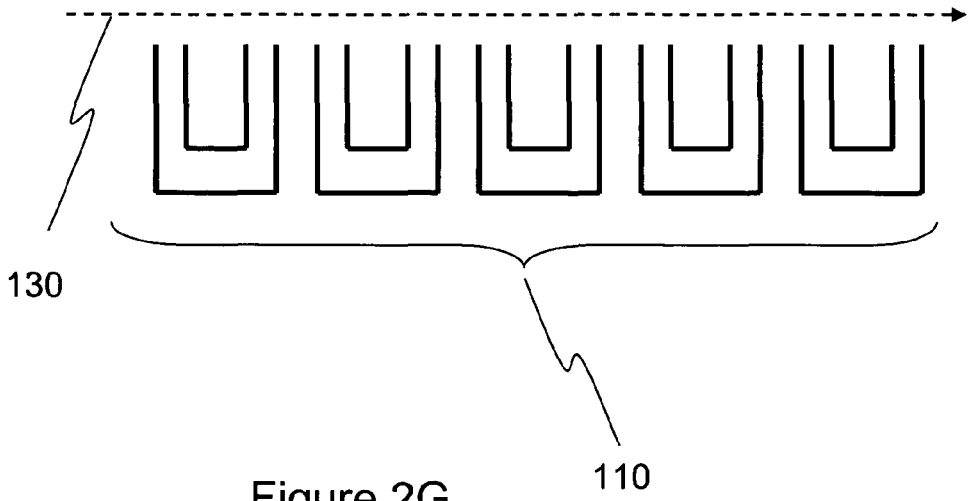
Figure 2H:
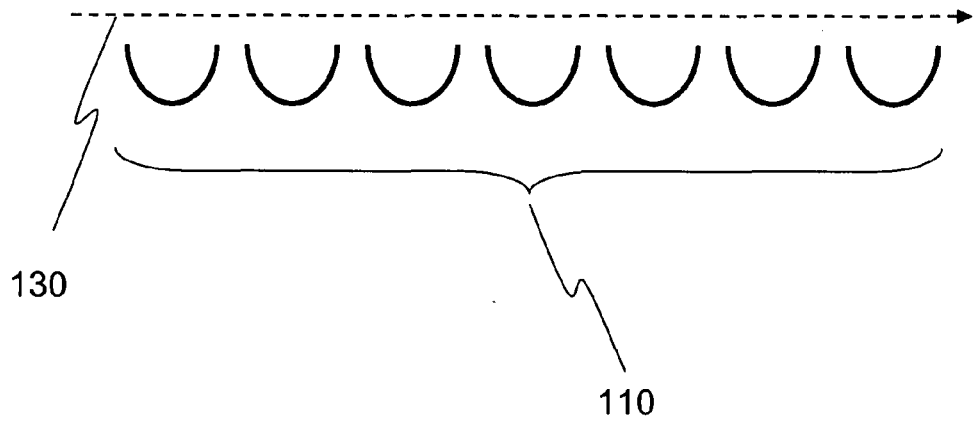

As shown in FIG. 2B, the fingers of the resonant structure 110 can be supplemented with a backbone. The backbone 112 connects the various fingers 115 of the resonant structure 110 forming a comb-like shape on its side. Typically, the backbone 112 would be made of the same material as the rest of the resonant structure 110, but alternate materials may be used. In addition, the backbone 112 may be formed in the same layer or a different layer than the fingers 110. The backbone 112 may also be formed in the same processing step or in a different processing step than the fingers 110. While the remaining figures do not show the use of a backbone 112, it should be appreciated that all other resonant structures described herein can be fabricated with a backbone also.

The shape of the fingers 115 (or posts) may also be shapes other than rectangles, such as simple shapes (e.g., circles, ovals, arcs and squares), complex shapes (e.g., such as semicircles, angled fingers, serpentine structures and embedded structures (i.e., structures with a smaller geometry within a larger geometry, thereby creating more complex resonances)) and those including waveguides or complex cavities. The finger structures of all the various shapes will be collectively referred to herein as "segments." Other exemplary shapes are shown in FIGS. 2C-2H, again with respect to a path of a beam 130. As can be seen at least from FIG. 2C, the axis of symmetry of the segments need not be perpendicular to the path of the beam 130.

Figure 3:
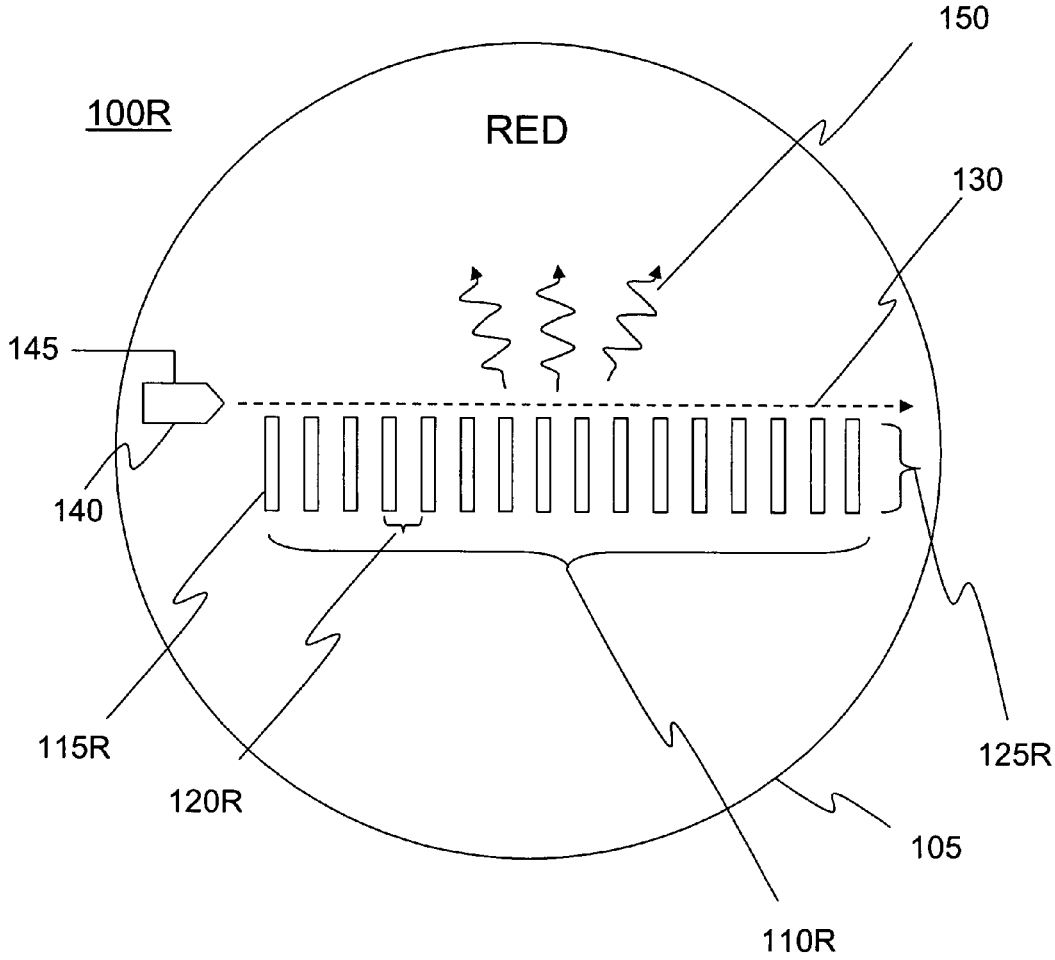
FIG. 3 is a top view of a single wavelength element having a first period and a first "finger" length according to one embodiment of the present invention.
Figure 4:
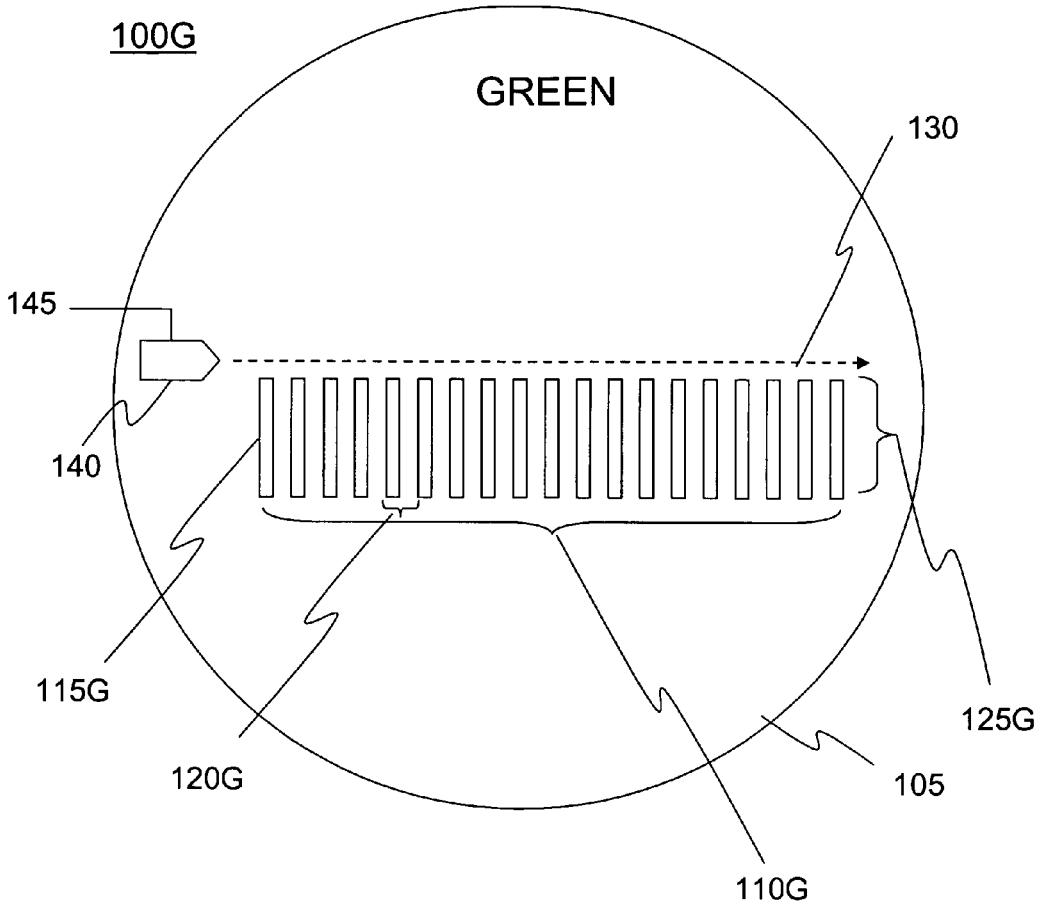
FIG. 4 is a top view of a single wavelength element having a second period and a second "finger" length according to one embodiment of the present invention.
Figure 5:
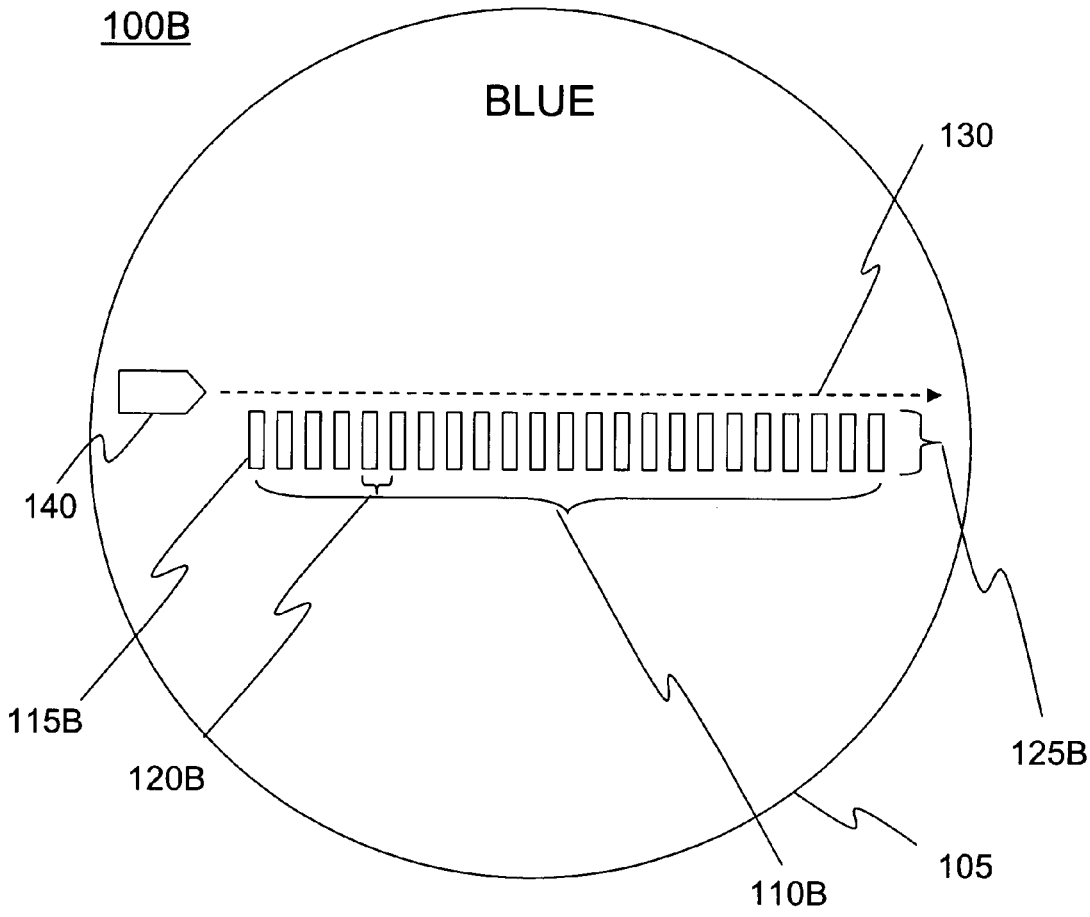
FIG. 5 is a top view of a single wavelength element having a third period and a third "finger" length according to one embodiment of the present invention.

Turning now to specific exemplary resonant elements, in FIG. 3, a wavelength element 100R for producing electromagnetic radiation with a first frequency is shown as having been constructed on a substrate 105. (The illustrated embodiments of FIGS. 3, 4 and 5 are described as producing red, green and blue light in the visible spectrum, respectively.

However, the spacings and lengths of the fingers 115R, 115G and 115B of the resonant structures 110R, 110G and 110B, respectively, are for illustrative purposes only and not intended to represent any actual relationship between the period 120 of the fingers, the lengths of the fingers 115 and the frequency of the emitted electromagnetic radiation.) However, the dimensions of exemplary resonant structures are provided in the table below.

| Wave-length | Period 120 | Segment thickness | Height 155 | Length 125 | # of fingers in a row |
|---|---|---|---|---|---|
| Red | 220 nm | 110 nm | 250-400 nm | 100-140 nm | 200-300 |
| Green | 171 nm | 85 nm | 250-400 nm | 180 nm | 200-300 |
| Blue | 158 nm | 78 nm | 250-400 nm | 60-120 nm | 200-300 |

As dimensions (e.g., height and/or length) change the intensity of the radiation may change as well. Moreover, depending on the dimensions, harmonics (e.g., second and third harmonics) may occur. For post height, length, and width, intensity appears oscillatory in that finding the optimal peak of each mode created the highest output. When operating in the velocity dependent mode (where the finger period depicts the dominant output radiation) the alignment of the geometric modes of the fingers are used to increase the output intensity. However it is seen that there are also radiation components due to geometric mode excitation during this time, but they do not appear to dominate the output. Optimal overall output comes when there is constructive modal alignment in as many axes as possible.

Other dimensions of the posts and cavities can also be swept to improve the intensity. A sweep of the duty cycle of the cavity space width and the post thickness indicates that the cavity space width and period (i.e., the sum of the width of one cavity space width and one post) have relevance to the center frequency of the resultant radiation. That is, the center frequency of resonance is generally determined by the post/space period. By sweeping the geometries, at given electron velocity v and current density, while evaluating the characteristic harmonics during each sweep, one can ascertain a predictable design model and equation set for a particular metal layer type and construction. Each of the dimensions mentioned above can be any value in the nanostructure range, i.e., 1 nm to several μm. Within such parameters, a series of posts can be constructed so that the emitted EMR of the resonant structures is substantially in the infrared, visible and ultraviolet portions of the spectrum and which can be optimized based on alterations of the geometry, electron velocity and density, and metal/layer type. It is also be possible to generate EMR of longer wavelengths as well. Unlike a Smith-Purcell device, the resultant radiation from such a structure is intense enough to be visible to the human eye with only 30 nanoamperes of current.

Using the above-described sweeps, one can also find the point of maximum intensity for posts of a particular geometry. Additional options also exist to widen the bandwidth or even have multiple frequency points on a single device. Such options include irregularly shaped posts and spacing, series arrays of non-uniform periods, asymmetrical post orientation, multiple beam configurations, etc.

As shown in FIG. 3, in a red element 100R, a beam 130 of charged particles (e.g., electrons, or positively or negatively charged ions) is emitted from a source 140 of charged particles under the control of a data input 145. The beam 130 passes close enough to the resonant structure 110R, with a spacing 120R, a finger length 125R and a finger height 155R (See, FIG. 8), to excite a response from the fingers and their associated cavities (or spaces). The source 140 is turned on when an input signal is received that indicates that the resonant structure 110R is to be excited. When the input signal indicates that the resonant structure 110R is not to be excited, the source 140 is turned off.

The illustrated EMR 150 is intended to denote that, in response to the data input 145 turning on the source 140, a red wavelength is emitted from the resonant structure 110R. In the illustrated embodiment, the beam 130 passes next to the resonant structure 110R which is shaped like a series of rectangular fingers 115R or posts.

The resonant structure 110R is fabricated utilizing any one of a variety of techniques (e.g., semiconductor processing-style techniques such as reactive ion etching, wet etching and pulsed plating) that produce small shaped features.

In response to the beam 130, electromagnetic radiation 150 is emitted there from which can be directed to an exterior of the element 100R.

As shown in FIG. 4, a green element 100G includes a second source 140 providing a second beam 130 in close proximity to a resonant structure 110G having a set of fingers 115G with a spacing 120G, a finger length 125G and a finger height 155G (see FIG. 9) which may be different than the spacing 120R, finger length 125R and finger height 155R of the resonant structure 110R. The finger length 125, finger spacing 120 and finger height 155 may be varied during design time to determine optimal finger lengths 125, finger spacings 120 and finger heights 155 to be used in the desired application.

As shown in FIG. 5, a blue element 100B includes a third source 140 providing a third beam 130 in close proximity to a resonant structure 110B having a set of fingers 115B having a spacing 120B, a finger length 125B and a finger height 155B (see FIG. 10) which may be different than the spacing 120R, length 125R and height 155R of the resonant structure 110R and which may be different than the spacing 120G, length 125G and height 155G of the resonant structure 110G.

The cathode sources of electron beams, as one example of the charged particle beam, are usually best constructed off of the chip or board onto which the conducting structures are constructed. In such a case, we incorporate an off-site cathode with a deflector, diffractor, or switch to direct one or more electron beams to one or more selected rows of the resonant structures. The result is that the same conductive layer can produce multiple light (or other EMR) frequencies by selectively inducing resonance in one of plural resonant structures that exist on the same substrate 105.

Figure 6A:
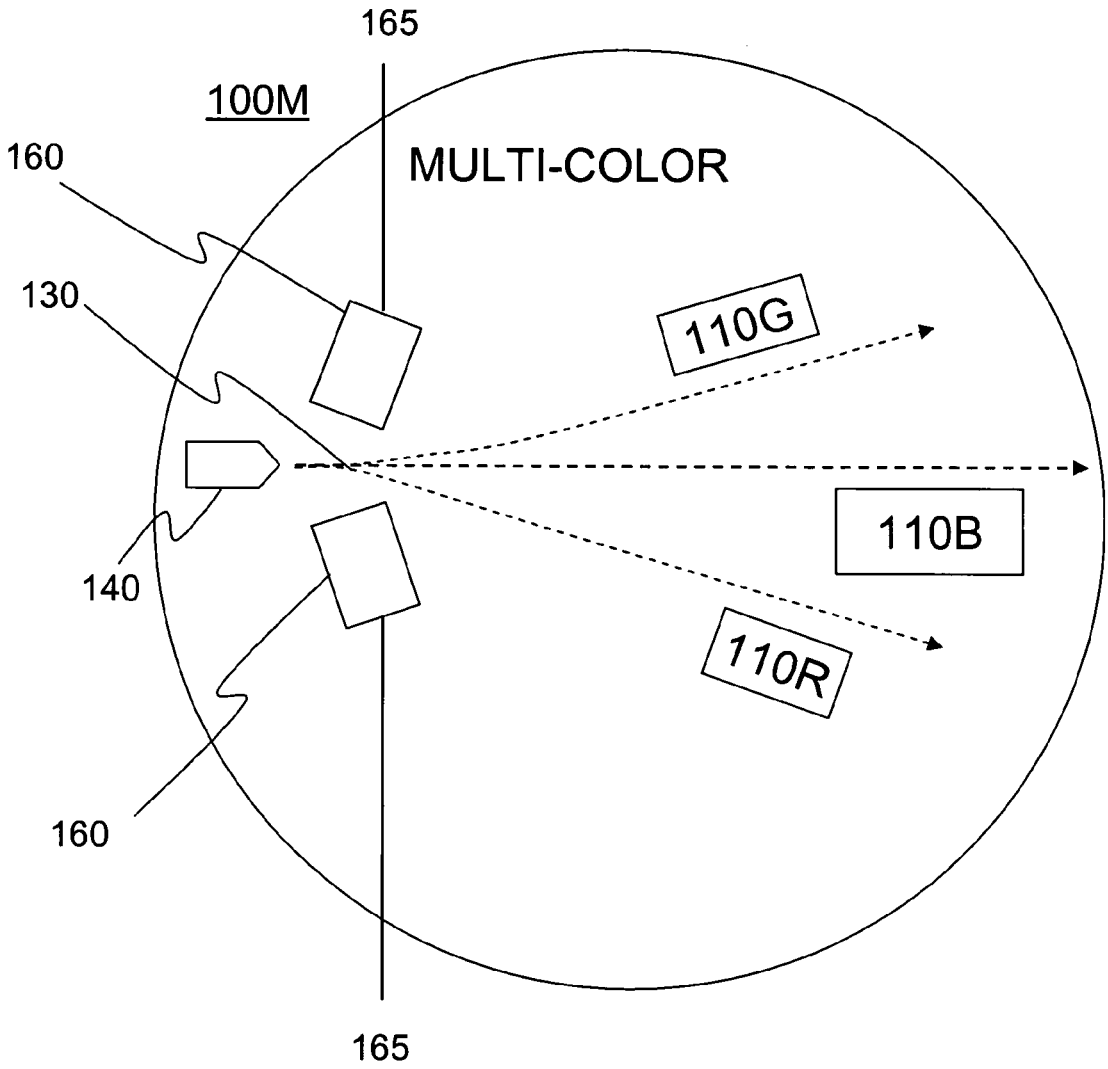
FIG. 6A is a top view of a multi-wavelength element utilizing two deflectors according to one embodiment of the present invention.

In an embodiment shown in FIG. 6A, an element is produced such that plural wavelengths can be produced from a single beam 130. In the embodiment of FIG. 6A, two deflectors 160 are provided which can direct the beam towards a desired resonant structure 110G, 110B or 110R by providing a deflection control voltage on a deflection control terminal 165. One of the two deflectors 160 is charged to make the beam bend in a first direction toward a first resonant structure, and the other of the two deflectors can be charged to make the beam bend in a second direction towards a second resonant structure. Energizing neither of the two deflectors 160 allows the beam 130 to be directed to yet a third of the resonant structures. Deflector plates are known in the art and include, but are not limited to, charged plates to which a voltage differential can be applied and deflectors as are used in cathode-ray tube (CRT) displays.

While FIG. 6A illustrates a single beam 130 interacting with three resonant structures, in alternate embodiments a larger or smaller number of resonant structures can be utilized in the multi-wavelength element 100M. For example, utilizing only two resonant structures 110G and 110B ensures that the beam does not pass over or through a resonant structure as it would when bending toward 110R if the beam 130 were left on. However, in one embodiment, the beam 130 is turned off while the deflector(s) is/are charged to provide the desired deflection and then the beam 130 is turned back on again.

Figure 6B:
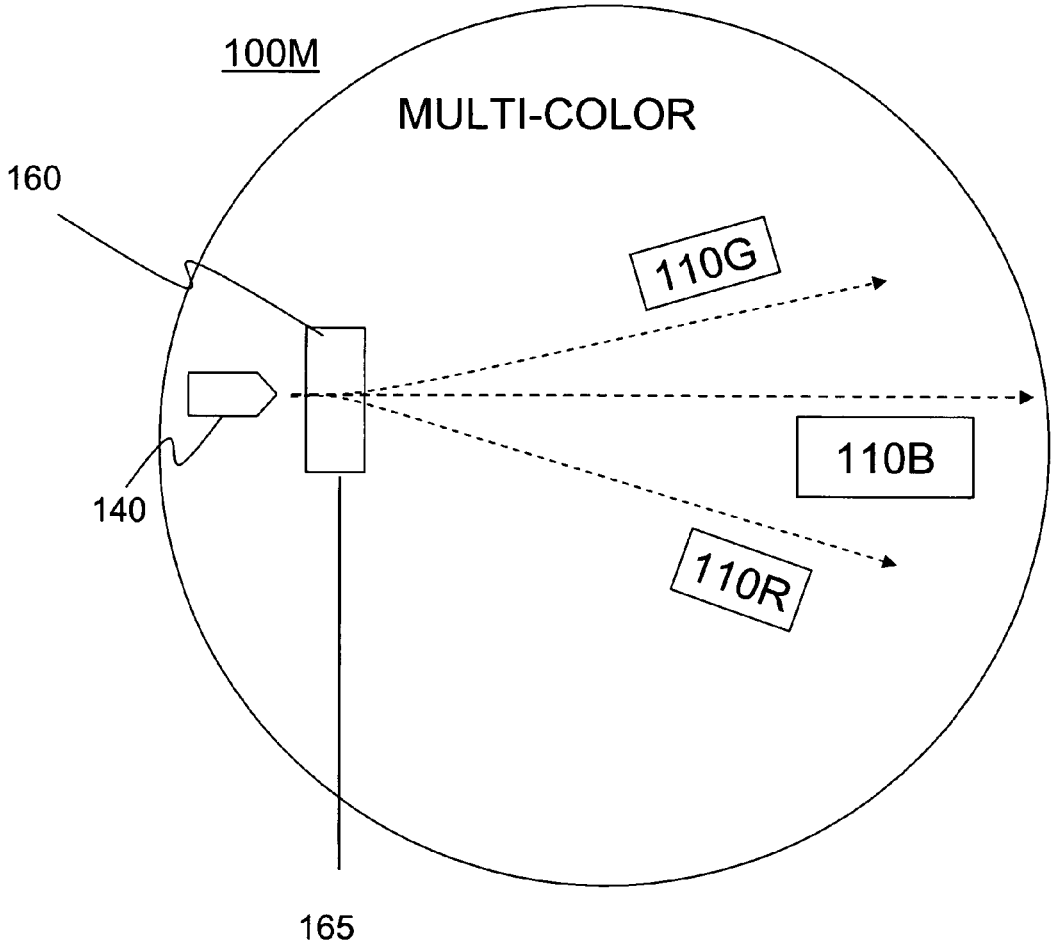
FIG. 6B is a top view of a multi-wavelength element utilizing a single, integrated deflector according to one embodiment of the present invention.
Figure 6C:
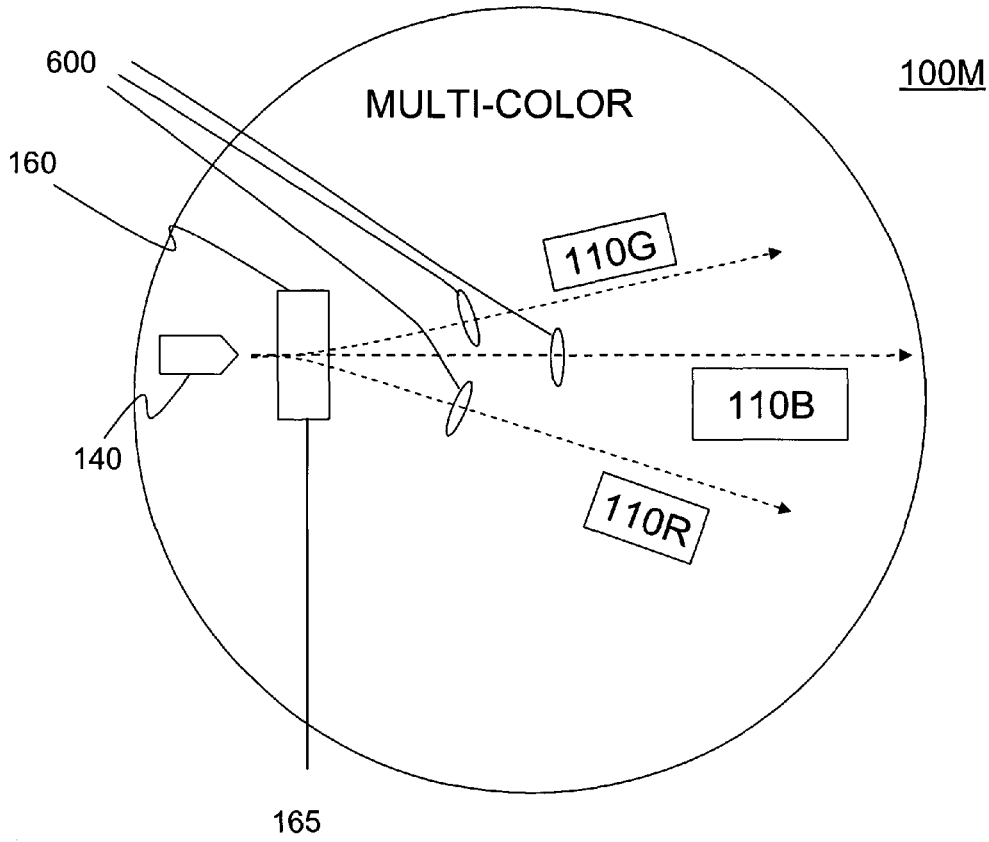
FIG. 6C is a top view of a multi-wavelength element utilizing a single, integrated deflector and focusing charged particle optical elements according to one embodiment of the present invention.

In yet another embodiment illustrated in FIG. 6B, the multi-wavelength structure 100M of FIG. 6A is modified to utilize a single deflector 160 with sides that can be individually energized such that the beam 130 can be deflected toward the appropriate resonant structure. The multi-wavelength element 100M of FIG. 6C also includes (as can any embodiment described herein) a series of focusing charged particle optical elements 600 in front of the resonant structures 110R, 110G and 110B.

Figure 6D:
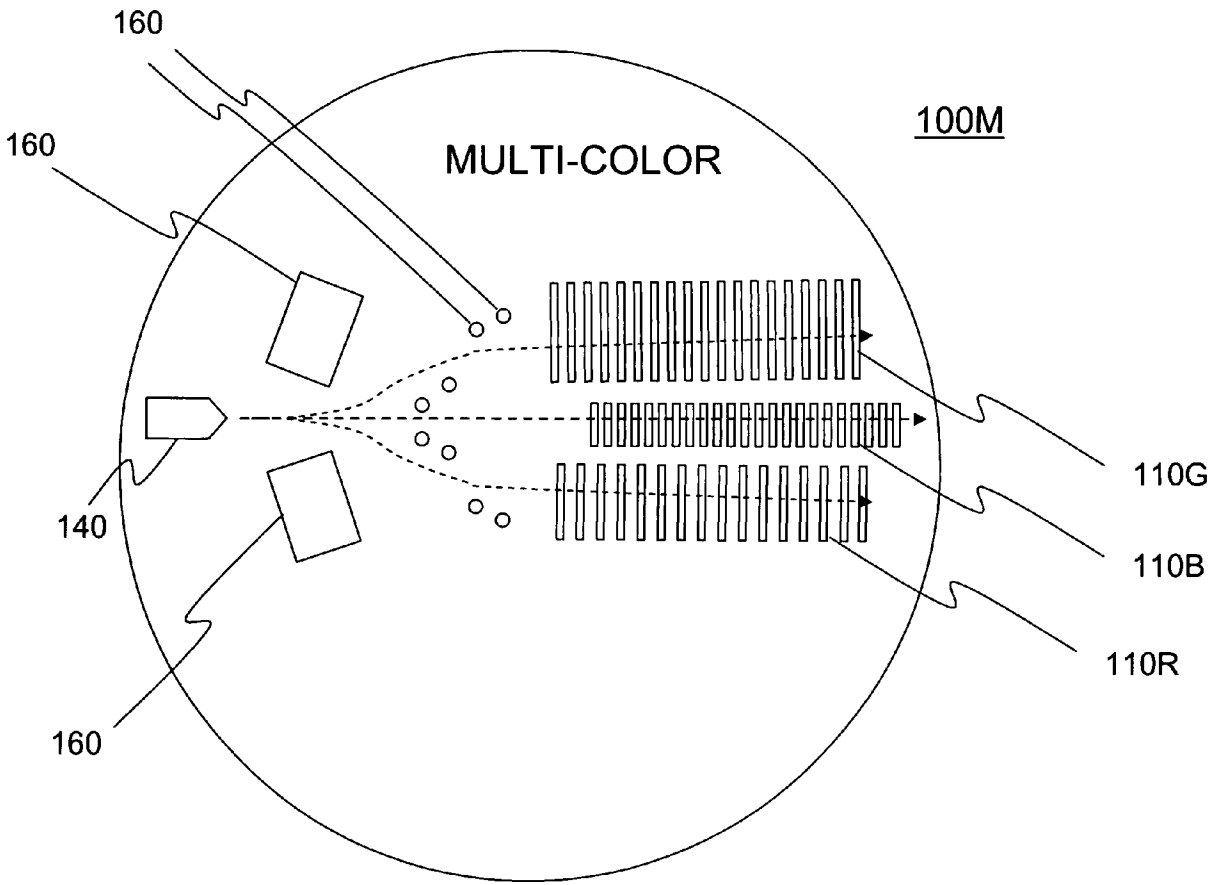
FIG. 6D is a top view of a multi-wavelength element utilizing plural deflectors along various points in the path of the beam according to one embodiment of the present invention.

In yet another embodiment illustrated in FIG. 6D, the multi-wavelength structure 100M of FIG. 6A is modified to utilize additional deflectors 160 at various points along the path of the beam 130. Additionally, the structure of FIG. 6D has been altered to utilize a beam that passes over, rather than next to, the resonant structures 110R, 110G and 110B.

Figure 7:
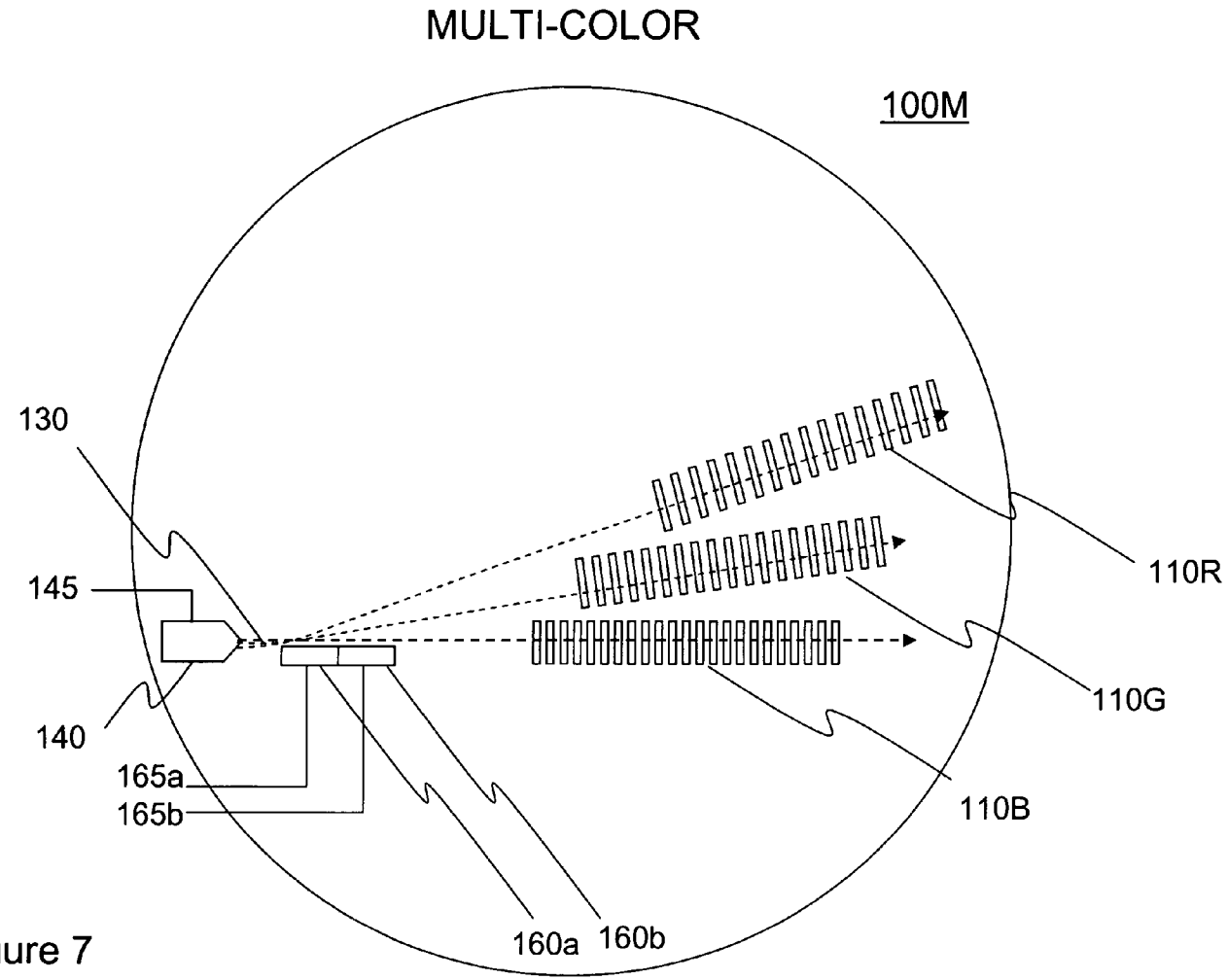
FIG. 7 is a top view of a multi-wavelength element utilizing two serial deflectors according to one embodiment of the present invention.

Alternatively, as shown in FIG. 7, rather than utilize parallel deflectors (e.g., as in FIG. 6A), a set of at least two deflectors 160*a,b* may be utilized in series. Each of the deflectors includes a deflection control terminal 165 for controlling whether it should aid in the deflection of the beam 130. For example, with neither of deflectors 160*a,b* energized, the beam 130 is not deflected, and the resonant structure 110B is excited. When one of the deflectors 160*a,b* is energized but not the other, then the beam 130 is deflected towards and excites resonant structure 110G. When both of the deflectors 160*a,b* are energized, then the beam 130 is deflected towards and excites resonant structure 110R. The number of resonant structures could be increased by providing greater amounts of beam deflection, either by adding additional deflectors 160 or by providing variable amounts of deflection under the control of the deflection control terminal 165.

Alternatively, "directors" other than the deflectors 160 can be used to direct/deflect the electron beam 130 emitted from the source 140 toward any one of the resonant structures 110 discussed herein. Directors 160 can include any one or a combination of a deflector 160, a diffractor, and an optical structure (e.g., switch) that generates the necessary fields.

Figure 8:
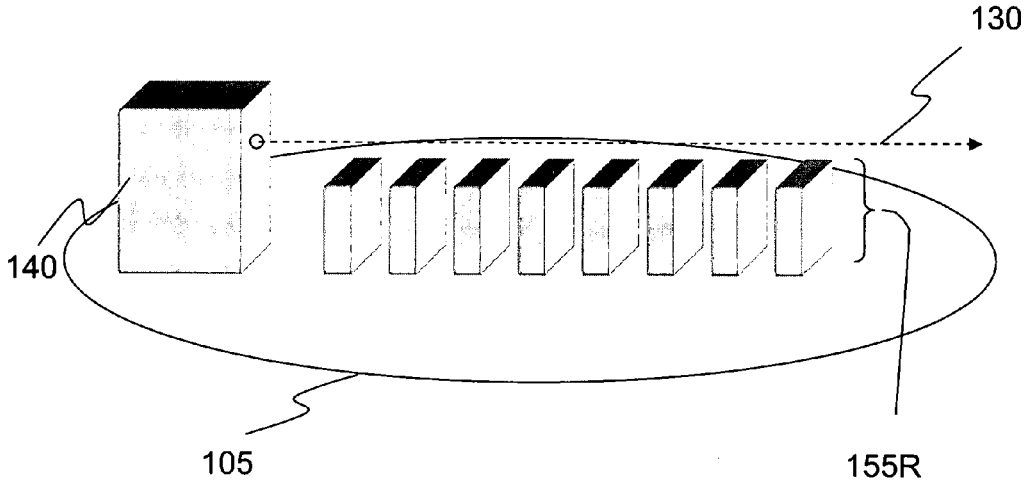
FIG. 8 is a perspective view of a single wavelength element having a first period and a first resonant frequency or "finger" length according to one embodiment of the present invention.
Figure 9:
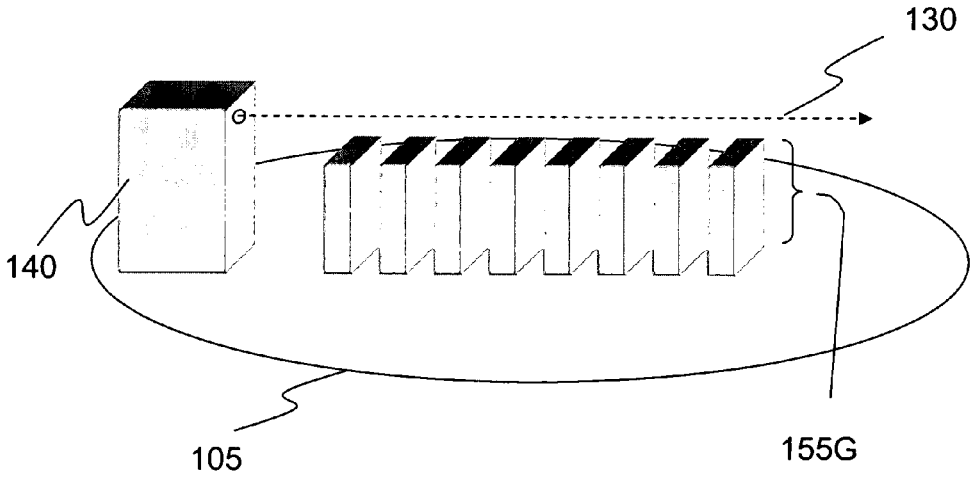
FIG. 9 is a perspective view of a single wavelength element having a second period and a second "finger" length according to one embodiment of the present invention.
Figure 10:
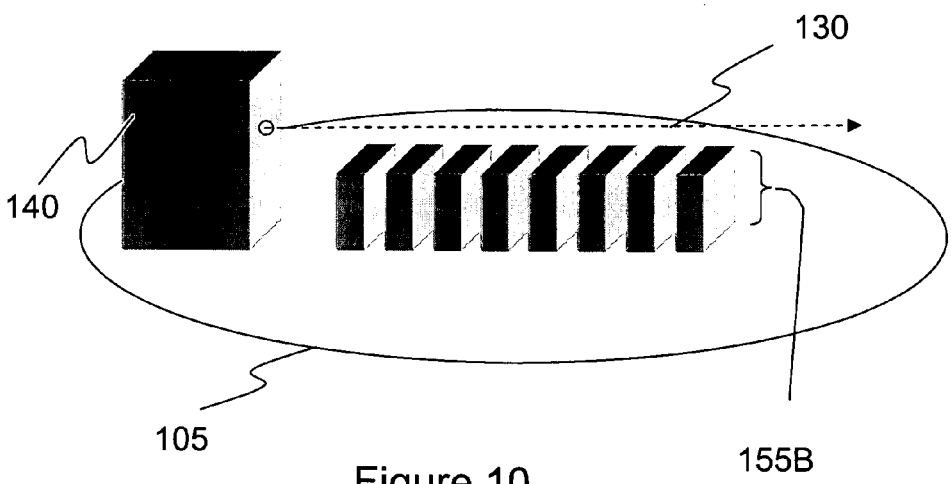
FIG. 10 is a perspective view of a single wavelength element having a third period and a third "finger" length according to one embodiment of the present invention.

While many of the above embodiments have been discussed with respect to resonant structures having beams 130 passing next to them, such a configuration is not required. Instead, the beam 130 from the source 140 may be passed over top of the resonant structures. FIGS. 8, 9 and 10 illustrate a variety of finger lengths, spacings and heights to illustrate that a variety of EMR 150 frequencies can be selectively produced according to this embodiment as well.

Figure 11:
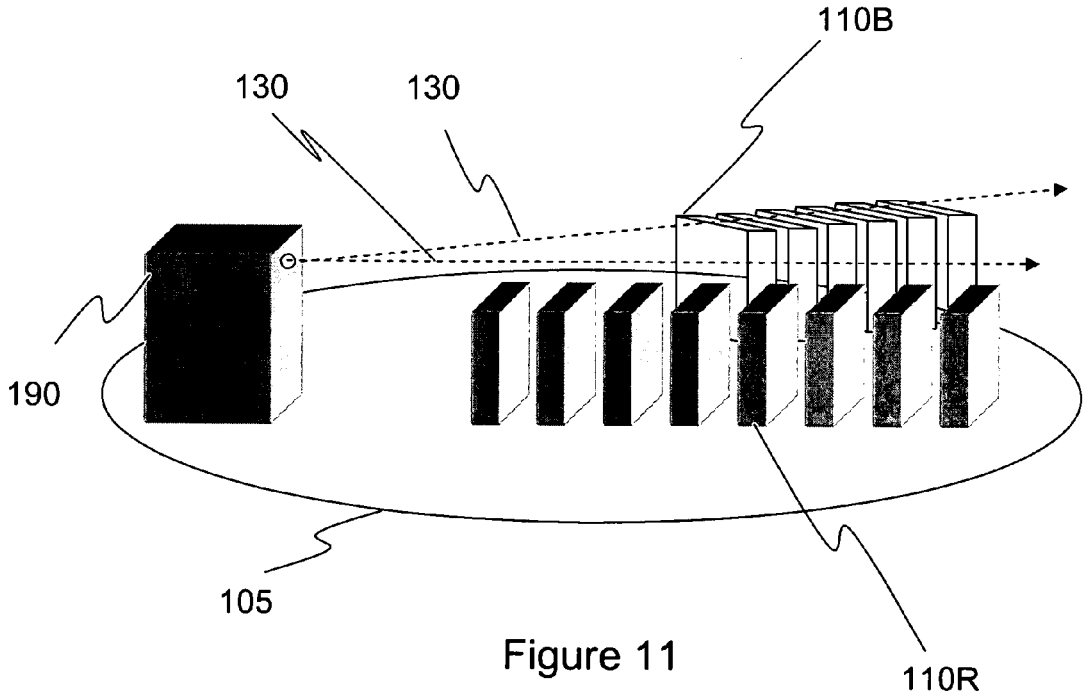
FIG. 11 is a perspective view of a portion of a multi-wavelength element having wavelength elements with different periods and "finger" lengths.

Furthermore, as shown in FIG. 11, the resonant structures of FIGS. 8-10 can be modified to utilize a single source 190 which includes a deflector therein. However, as with the embodiments of FIGS. 6A-7, the deflectors 160 can be separate from the charged particle source 140 as well without departing from the present invention. As shown in FIG. 11, fingers of different spacings and potentially different lengths and heights are provided in close proximity to each other. To activate the resonant structure 110R, the beam 130 is allowed to pass out of the source 190 undeflected. To activate the resonant structure 110B, the beam 130 is deflected after being generated in the source 190. (The third resonant structure for the third wavelength element has been omitted for clarity.)

Figure 12:
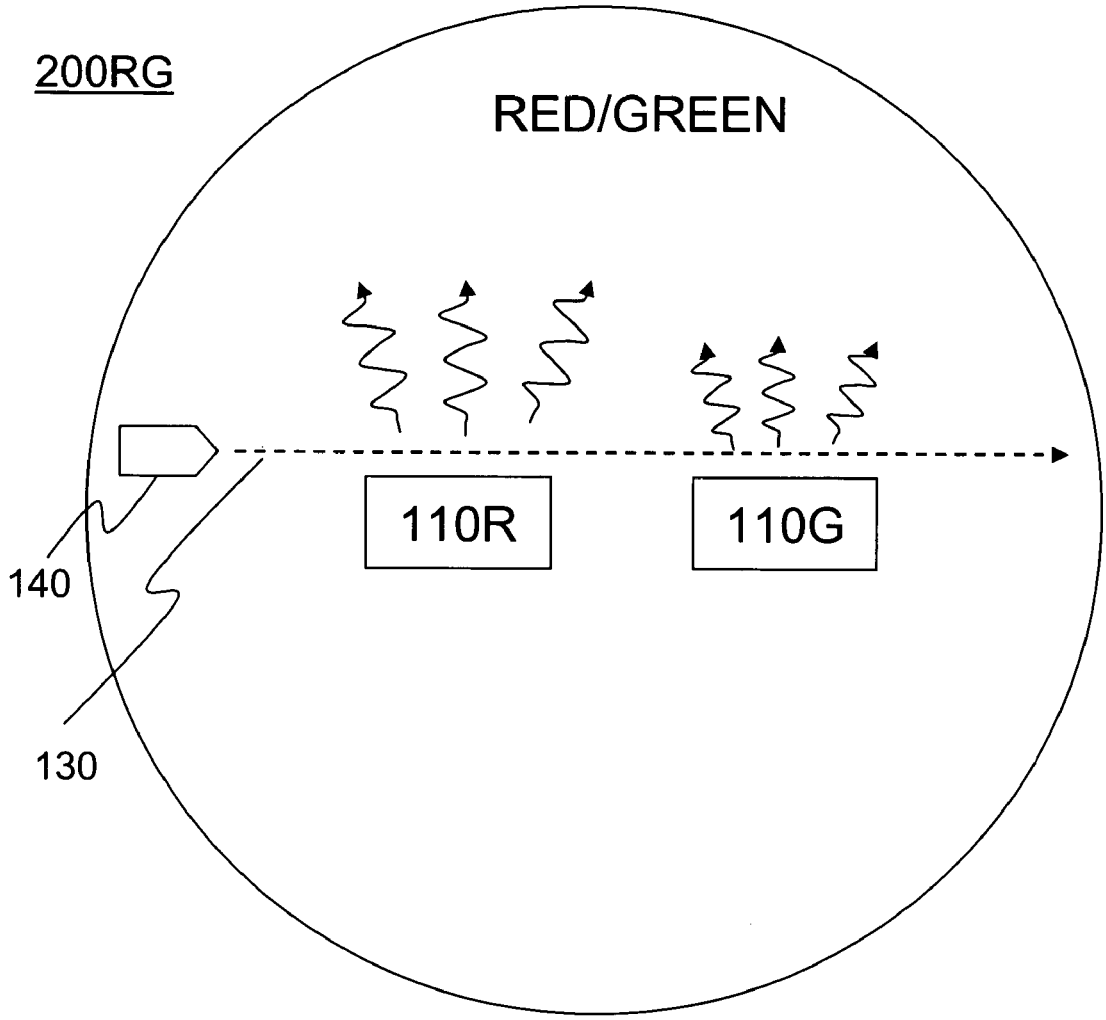
FIG. 12 is a top view of a multi-wavelength element according to one embodiment of the present invention.

While the above elements have been described with reference to resonant structures 110 that have a single resonant structure along any beam trajectory, as shown in FIG. 12, it is possible to utilize wavelength elements 200RG that include plural resonant structures in series (e.g., with multiple finger spacings and one or more finger lengths and finger heights per element). In such a configuration, one may obtain a mix of wavelengths if this is desired. At least two resonant structures in series can either be the same type of resonant structure (e.g., all of the type shown in FIG. 2A) or may be of different types (e.g., in an exemplary embodiment with three resonant structures, at least one of FIG. 2A, at least one of FIG. 2C, at least one of FIG. 2H, but none of the others).

Figure 13:
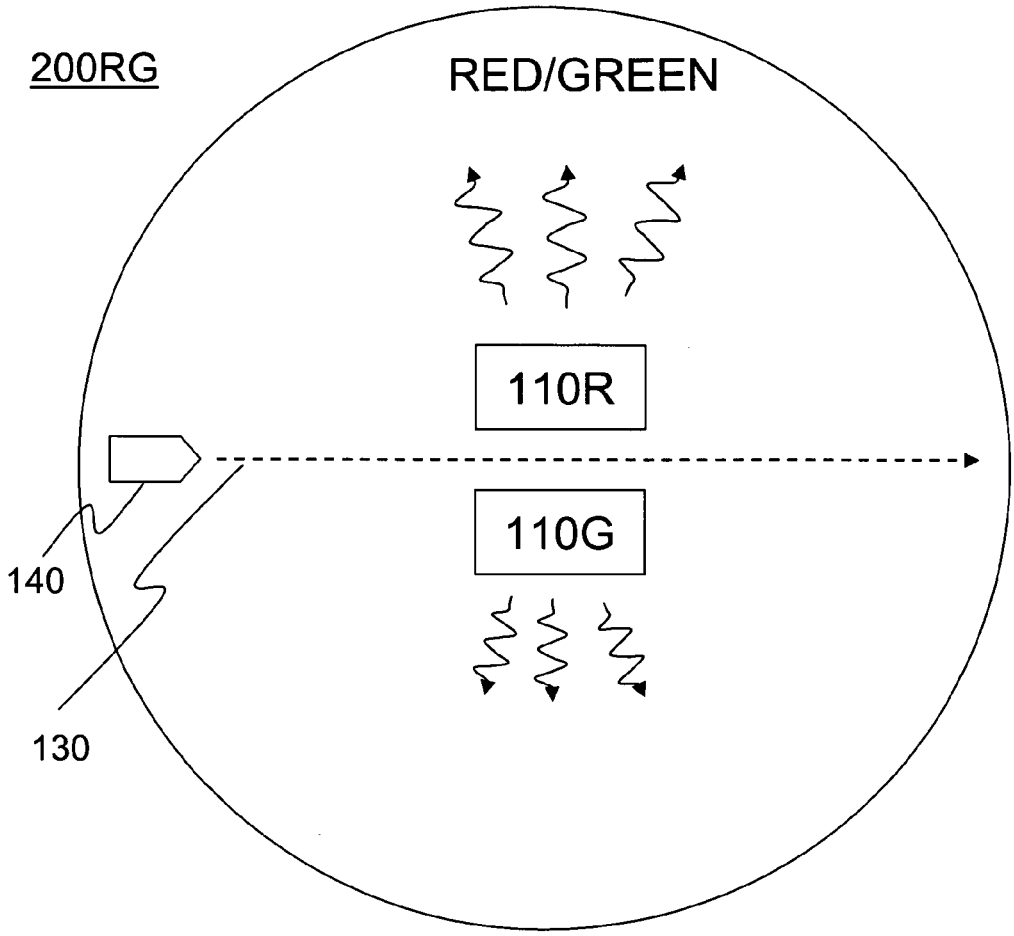
FIG. 13 is a top view of a multi-wavelength element according to another embodiment of the present invention.

Alternatively, as shown in FIG. 13, a single charged particle beam 130 (e.g., electron beam) may excite two resonant structures 110R and 110G in parallel. As would be appreciated by one of ordinary skill from this disclosure, the wavelengths need not correspond to red and green but may instead be any wavelength pairing utilizing the structure of FIG. 13.

It is possible to alter the intensity of emissions from resonant structures using a variety of techniques. For example, the charged particle density making up the beam 130 can be varied to increase or decrease intensity, as needed. Moreover, the speed that the charged particles pass next to or over the resonant structures can be varied to alter intensity as well.

Alternatively, by decreasing the distance between the beam 130 and a resonant structure (without hitting the resonant structure), the intensity of the emission from the resonant structure is increased. In the embodiments of FIGS. 3-7, this would be achieved by bringing the beam 130 closer to the side of the resonant structure. For FIGS. 8-10, this would be achieved by lowering the beam 130. Conversely, by increasing the distance between the beam 130 and a resonant structure, the intensity of the emission from the resonant structure is decreased.

Figure 14:
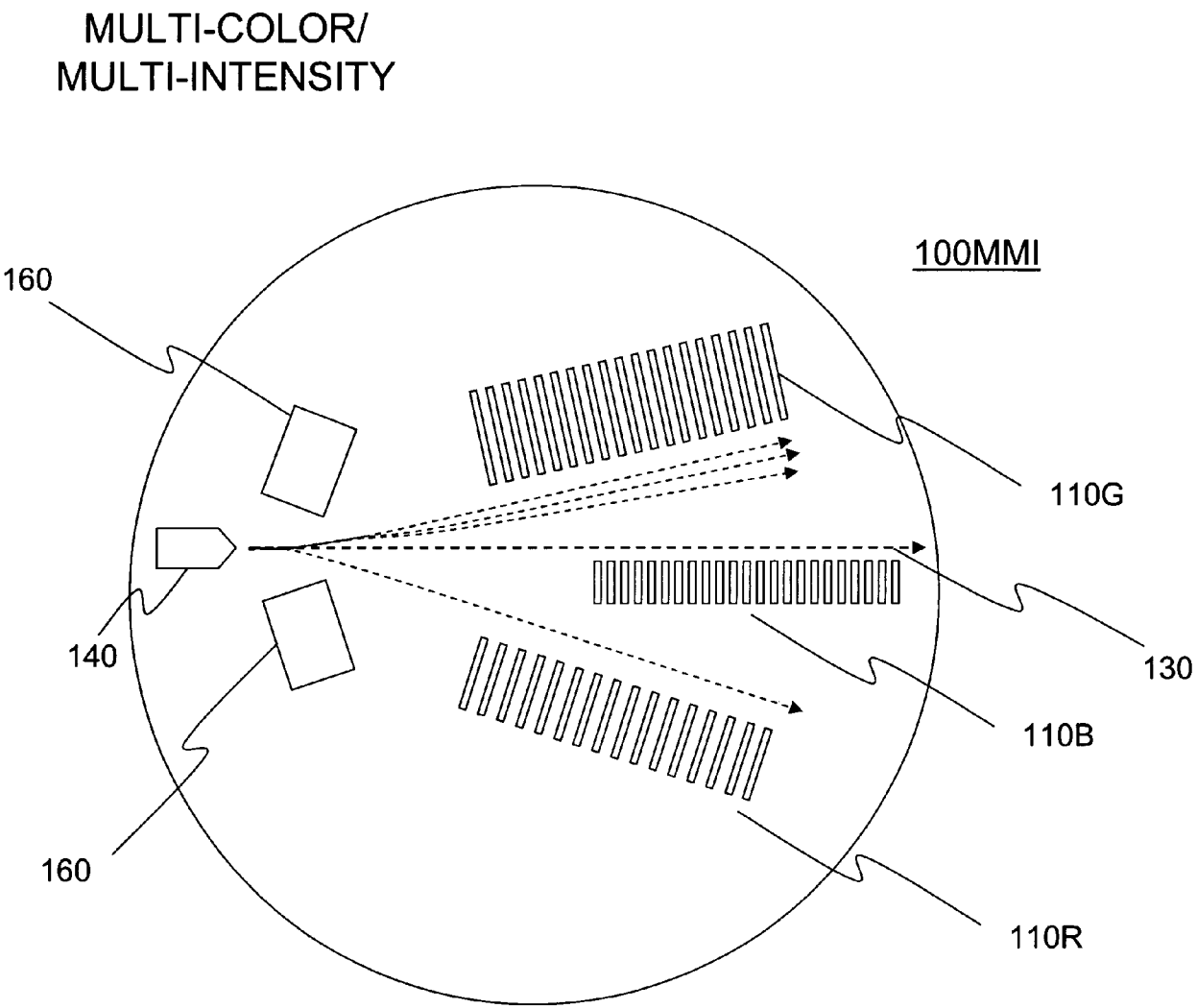
FIG. 14 is a top view of a multi-wavelength element utilizing two deflectors with variable amounts of deflection according to one embodiment of the present invention.

Turning to the structure of FIG. 14, it is possible to utilize at least one deflector 160 to vary the amount of coupling between the beam 130 and the resonant structures 110. As illustrated, the beam 130 can be positioned at three different distances away from the resonant structures 110. Thus, as illustrated at least three different intensities are possible for the green resonant structure, and similar intensities would be available for the red and green resonant structures. However, in practice a much larger number of positions (and corresponding intensities) would be used. For example, by specifying an 8-bit color component, one of 256 different positions would be selected for the position of the beam 130 when in proximity to the resonant structure of that color. Since the resonant structures for different may have different responses to the proximity of the beam, the deflectors are preferably controlled by a translation table or circuit that converts the desired intensity to a deflection voltage (either linearly or non-linearly).

Figure 15:
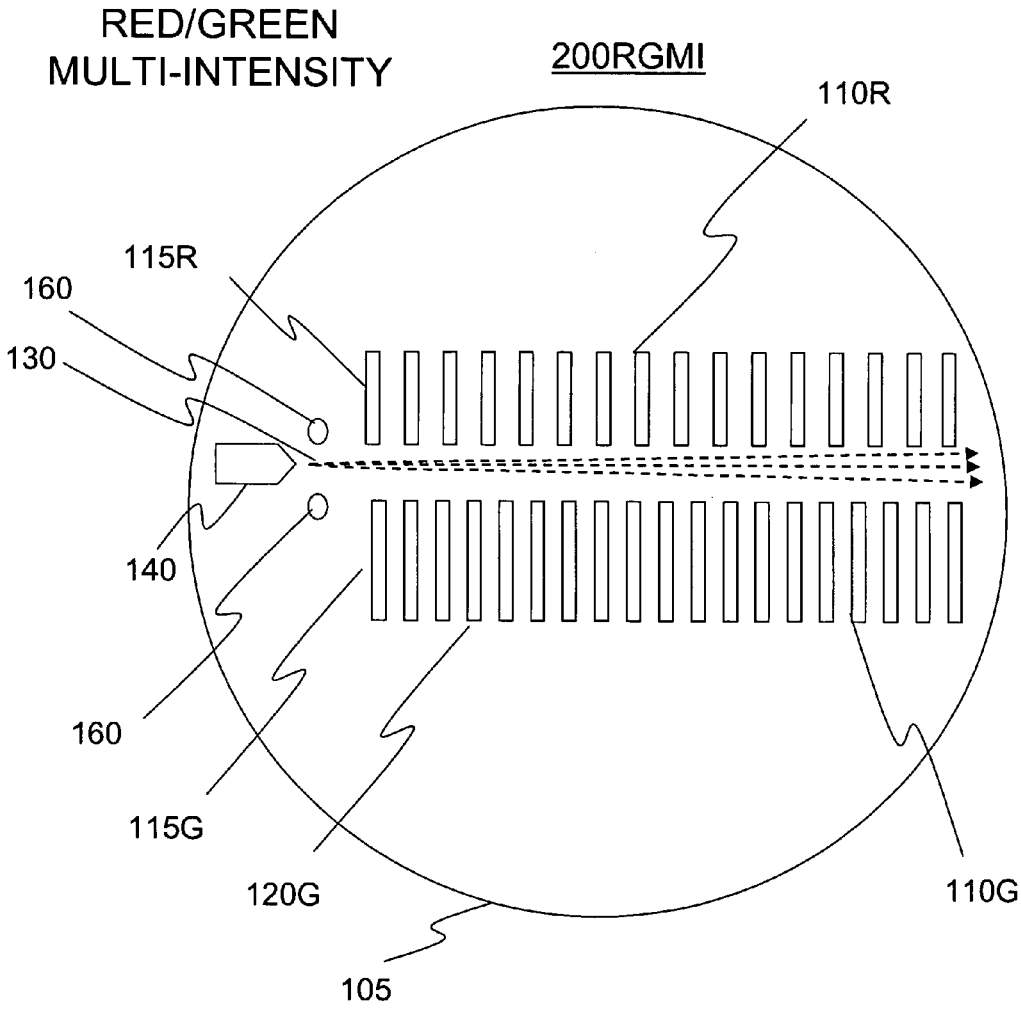
FIG. 15 is a top view of a multi-wavelength element utilizing two deflectors according to another embodiment of the present invention.

Moreover, as shown in FIG. 15, the structure of FIG. 13 may be supplemented with at least one deflector 160 which temporarily positions the beam 130 closer to one of the two structures 110R and 110G as desired. By modifying the path of the beam 130 to become closer to the resonant structures 110R and farther away from the resonant structure 110G, the intensity of the emitted electromagnetic radiation from resonant structure 110R is increased and the intensity of the emitted electromagnetic radiation from resonant structure 110G is decreased. Likewise, the intensity of the emitted electromagnetic radiation from resonant structure 110R can be decreased and the intensity of the emitted electromagnetic radiation from resonant structure 110G can be increased by modifying the path of the beam 130 to become closer to the resonant structures 110G and farther away from the resonant structure 110R. In this way, a multi-resonant structure utilizing beam deflection can act as a color channel mixer.

Figure 16:
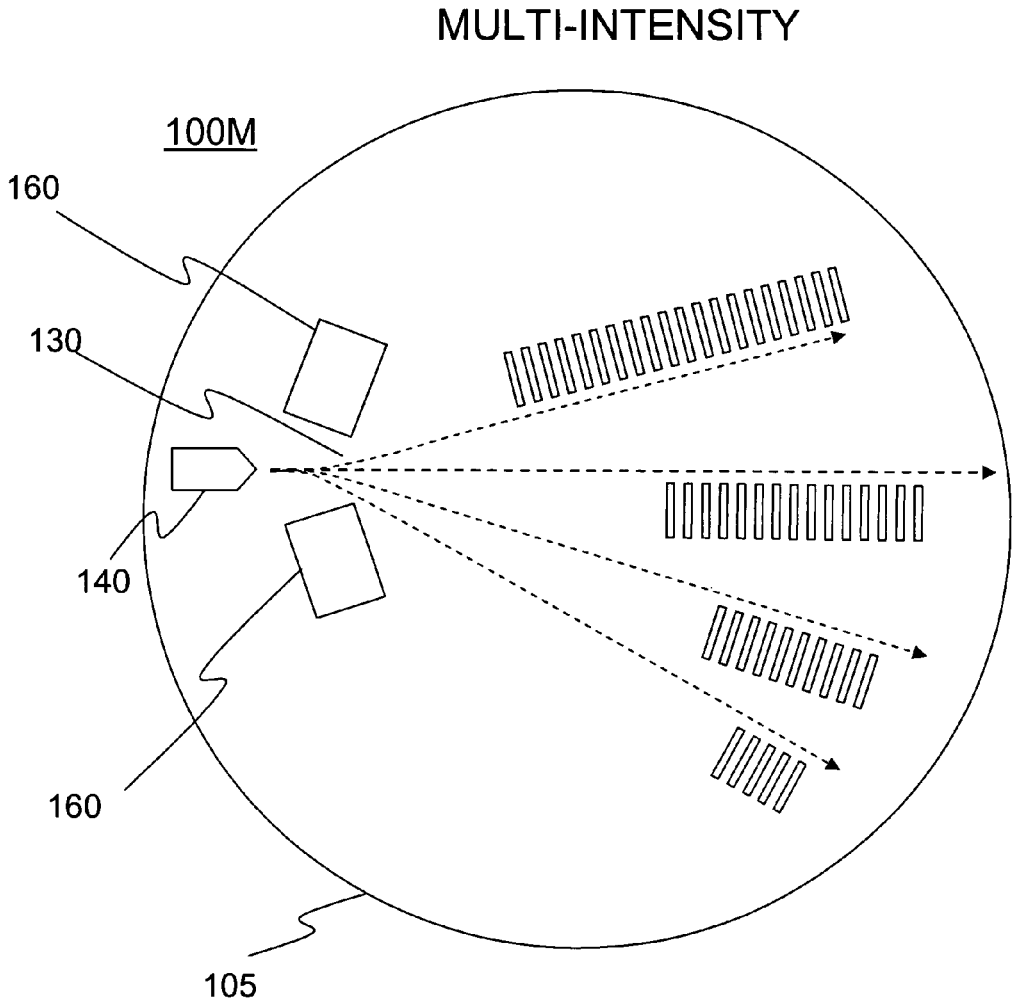
FIG. 16 is a top view of a multi-intensity element utilizing two deflectors according to another embodiment of the present invention.

As shown in FIG. 16, a multi-intensity pixel can be produced by providing plural resonant structures, each emitting the same dominant frequency, but with different intensities (e.g., based on different numbers of fingers per structure). As illustrated, the color component is capable of providing five different intensities (off, 25%, 50%, 75% and 100%). Such a structure could be incorporated into a device having multiple multi-intensity elements 100 per color or wavelength.

The illustrated order of the resonant structures is not required and may be altered. For example, the most frequently used intensities may be placed such that they require lower amounts of deflection, thereby enabling the system to utilize, on average, less power for the deflection.

Figure 17A:
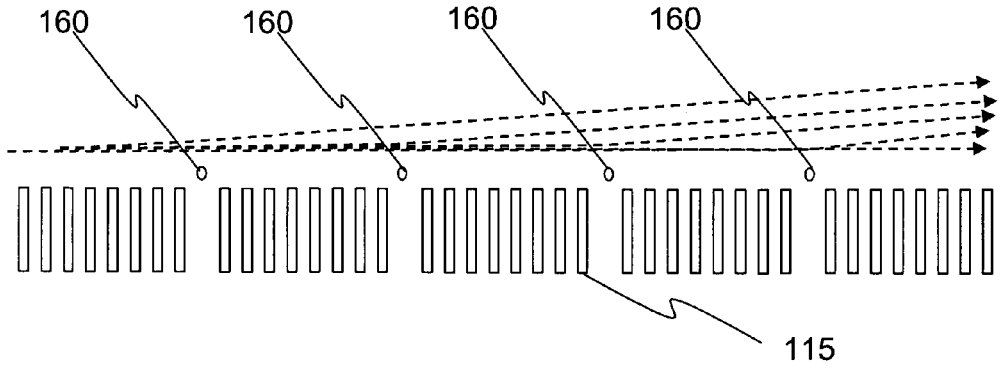
FIG. 17A is a top view of a multi-intensity element using plural inline deflectors.

As shown in FIG. 17A, the intensity can also be controlled using deflectors 160 that are inline with the fingers 115 and which repel the beam 130. By turning on the deflectors at the various locations, the beam 130 will reduce its interactions with later fingers 115 (i.e., fingers to the right in the figure). Thus, as illustrated, the beam can produce six different intensities (off, 20%, 40%, 60%, 80% and 100%) by turning the beam on and off and only using four deflectors, but in practice the number of deflectors can be significantly higher.

Figure 17B:
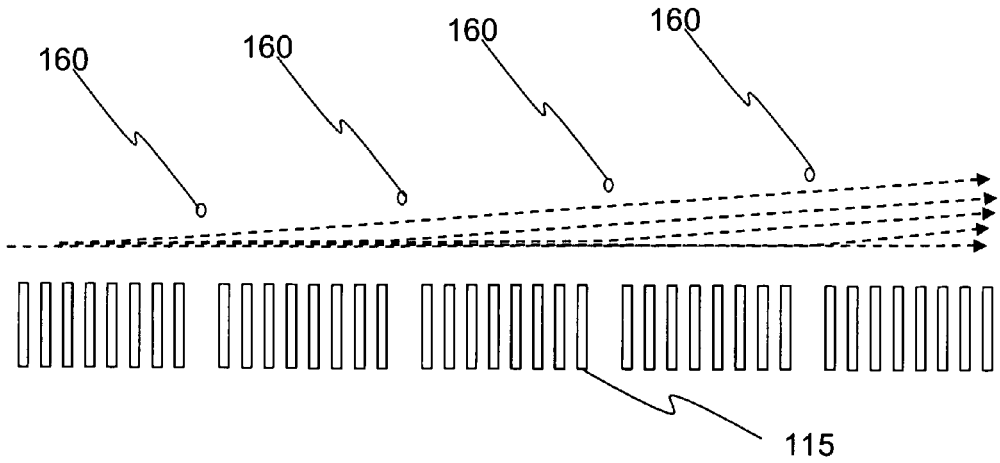
FIG. 17B is a top view of a multi-intensity element using plural attractive deflectors above the path of the beam.

Alternatively, as shown in FIG. 17B, a number of deflectors 160 can be used to attract the beam away from its undeflected path in order to change intensity as well.

Figure 17C:
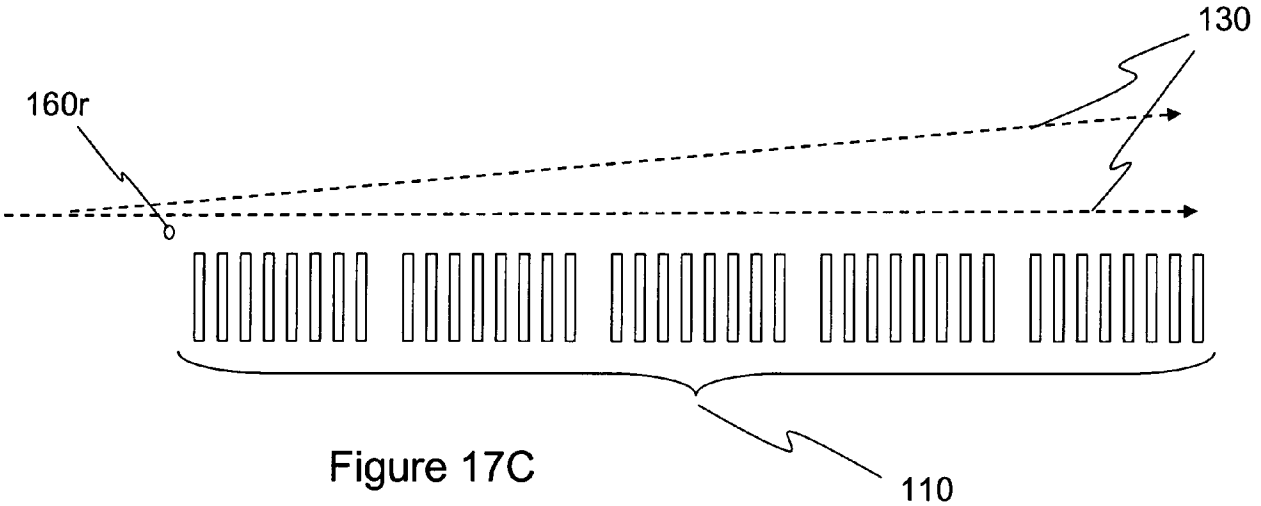
FIG. 17C is a view of a first deflectable beam for turning the resonant structures on and off without needing a separate data input on the source of charged particles and without having to turn off the source of charged particles.
Figure 17D:
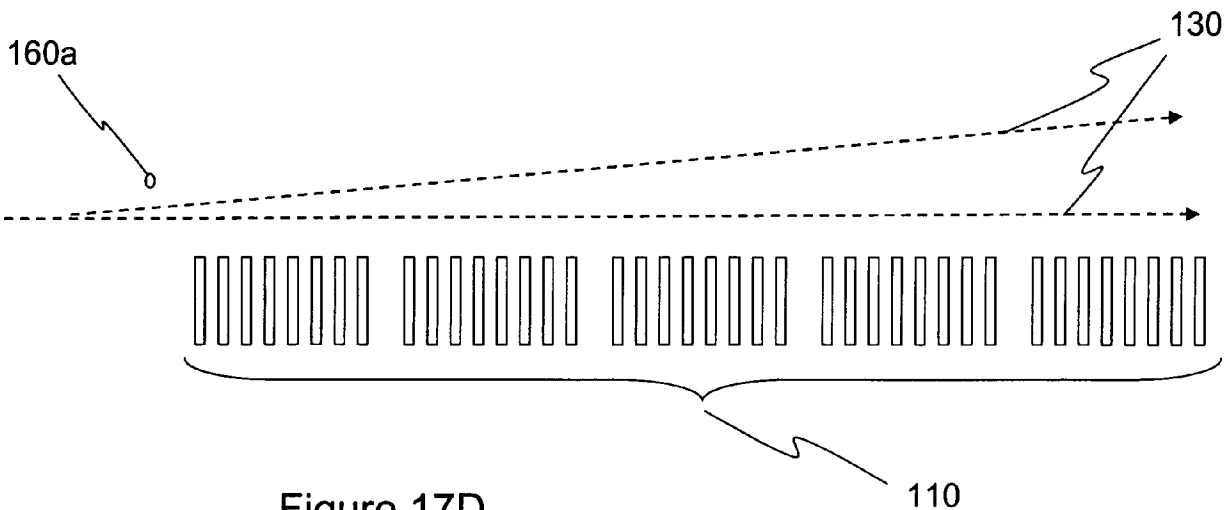
FIG. 17D is a view of a second deflectable beam for turning the resonant structures on and off without needing a separate data input on the source of charged particles and without having to turn off the source of charged particles.

In addition to the repulsive and attractive deflectors 160 of FIGS. 17A and 17B which are used to control intensity of multi-intensity resonators, at least one additional repulsive deflector 160*r* or at least one additional attractive deflector 160*a*, can be used to direct the beam 130 away from a resonant structure 110, as shown in FIGS. 17C and 17D, respectively. By directing the beam 130 before the resonant structure 110 is excited at all, the resonant structure 110 can be turned on and off, not just controlled in intensity, without having to turn off the source 140. Using this technique, the source 140 need not include a separate data input 145. Instead, the data input is simply integrated into the deflection control terminal 165 which controls the amount of deflection that the beam is to undergo, and the beam 130 is left on.

Furthermore, while FIGS. 17C and 17D illustrate that the beam 130 can be deflected by one deflector 160*a,r* before reaching the resonant structure 110, it should be understood that multiple deflectors may be used, either serially or in parallel. For example, deflector plates may be provided on both sides of the path of the charged particle beam 130 such that the beam 130 is cooperatively repelled and attracted simultaneously to turn off the resonant structure 110, or the deflector plates are turned off so that the beam 130 can, at least initially, be directed undeflected toward the resonant structure 110.

The configuration of FIGS. 17A-D is also intended to be general enough that the resonant structure 110 can be either a vertical structure such that the beam 130 passes over the resonant structure 110 or a horizontal structure such that the beam 130 passes next to the resonant structure 110. In the vertical configuration, the "off" state can be achieved by deflecting the beam 130 above the resonant structure 110 but at a height higher than can excite the resonant structure. In the horizontal configuration, the "off" state can be achieved by deflecting the beam 130 next to the resonant structure 110 but at a distance greater than can excite the resonant structure.

Alternatively, both the vertical and horizontal resonant structures can be turned "off" by deflecting the beam away from resonant structures in a direction other than the undeflected direction. For example, in the vertical configuration, the resonant structure can be turned off by deflecting the beam left or right so that it no longer passes over top of the resonant structure. Looking at the exemplary structure of FIG. 7, the off-state may be selected to be any one of: a deflection between 110B and 110G, a deflection between 110B and 110R, a deflection to the right of 110B, and a deflection to the left of 110R. Similarly, a horizontal resonant structure may be turned off by passing the beam next to the structure but higher than the height of the fingers such that the resonant structure is not excited.

In yet another embodiment, the deflectors may utilize a combination of horizontal and vertical deflections such that the intensity is controlled by deflecting the beam in a first direction but the on/off state is controlled by deflecting the beam in a second direction.

Figure 18A:
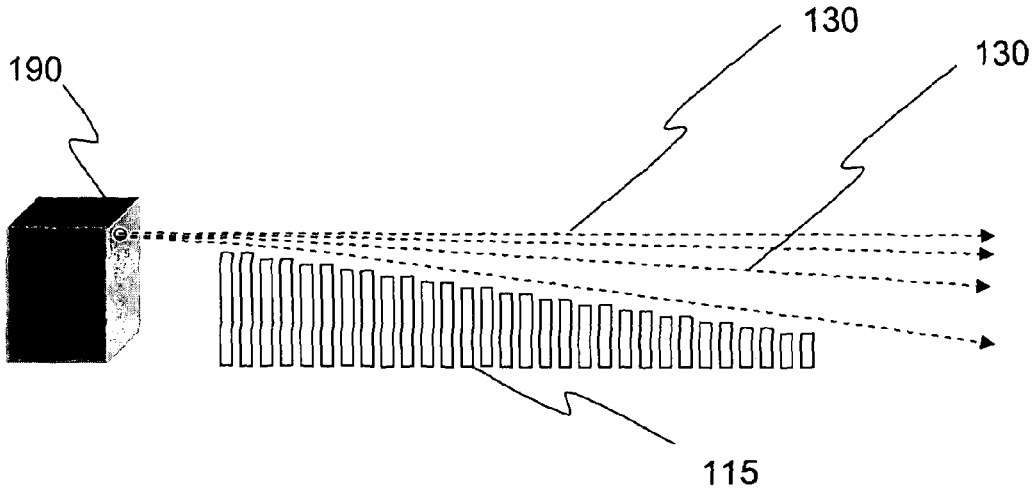
FIG. 18A is a top view of a multi-intensity element using finger of varying heights.

FIG. 18A illustrates yet another possible embodiment of a varying intensity resonant structure. (The change in heights of the fingers have been over exaggerated for illustrative purposes). As shown in FIG. 18A, a beam 130 is not deflected and interacts with a few fingers to produce a first low intensity output. However, as at least one deflector (not shown) internal to or above the source 190 increases the amount of deflection that the beam undergoes, the beam interacts with an increasing number of fingers and results in a higher intensity output.

Figure 18B:
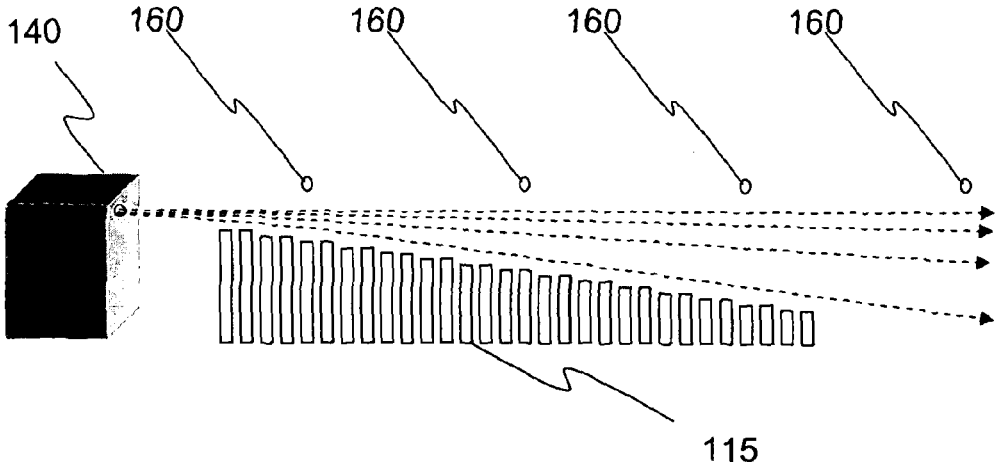
FIG. 18B is a top view of a multi-intensity element using finger of varying heights.

Alternatively, as shown in FIG. 18B, a number of deflectors can be placed along a path of the beam 130 to push the beam down towards as many additional segments as needed for the specified intensity.

While repulsive and attractive deflectors 160 have been illustrated in FIGS. 17A-18B as being above the resonant structures when the beam 130 passes over the structures, it should be understood that in embodiments where the beam 130 passes next to the structures, the deflectors can instead be next to the resonant structures.

Figure 19A:
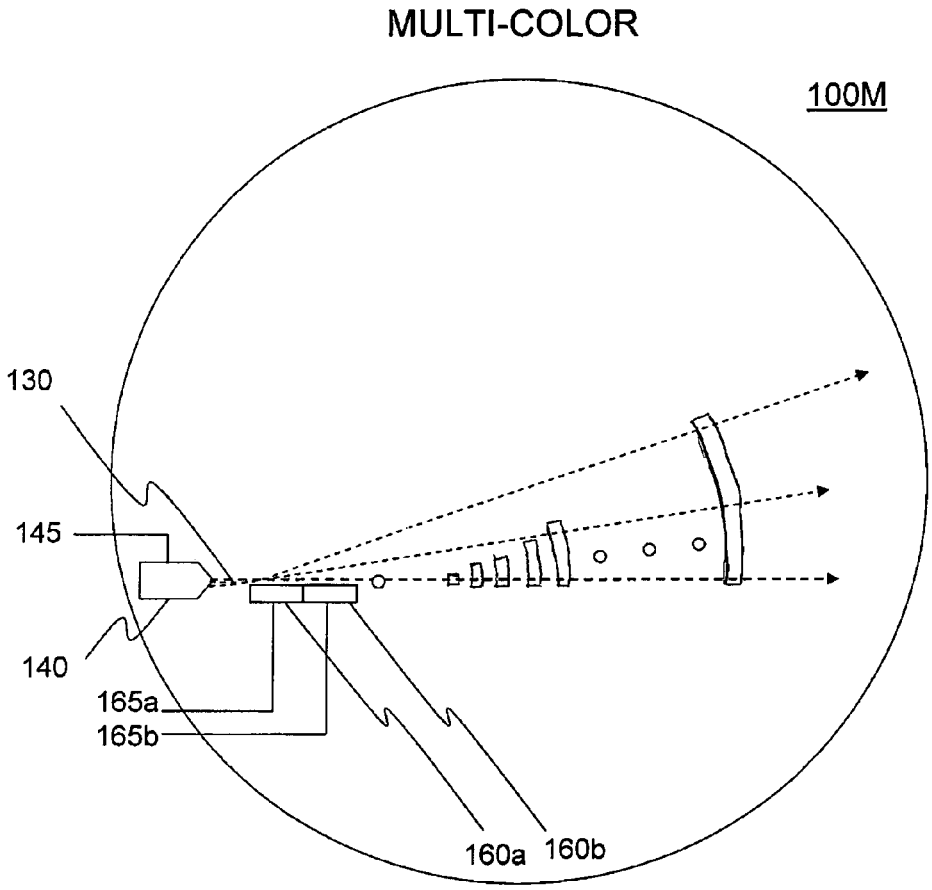
FIG. 19A is a top view of a fan-shaped resonant element that enables varying intensity based on the amount of deflection of the beam.
Figure 19B:
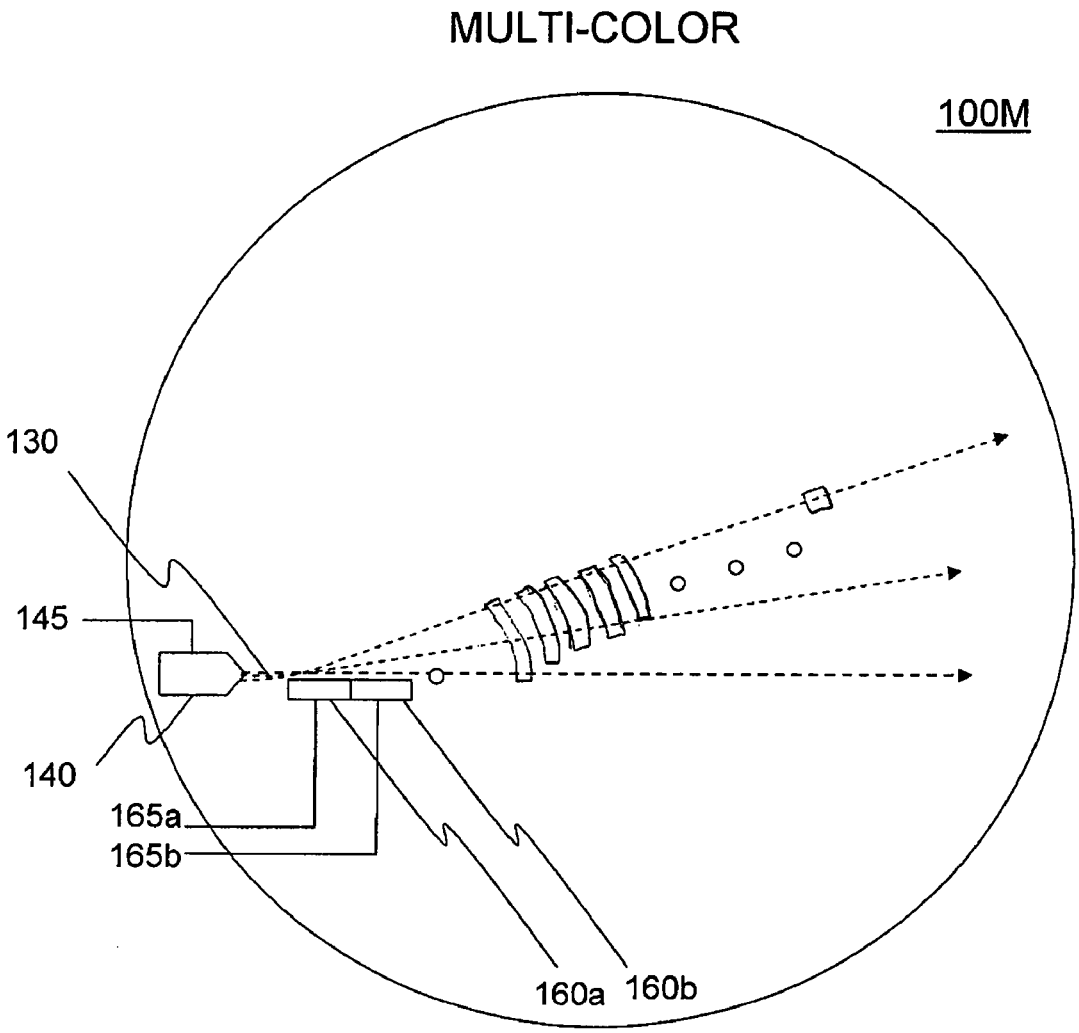
FIG. 19B is a top view of another fan-shaped resonant element that enables varying intensity based on the amount of deflection of the beam.

FIG. 19A illustrates an additional possible embodiment of a varying intensity resonant structure according to the present invention. According to the illustrated embodiment, segments shaped as arcs are provided with varying lengths but with a fixed spacing between arcs such that a desired frequency is emitted. (For illustrative purposes, the number of segments has been greatly reduced. In practice, the number of segments would be significantly greater, e.g., utilizing hundreds of segments.) By varying the lengths, the number of segments that are excited by the deflected beam changes with the angle of deflection. Thus, the intensity changes with the angle of deflection as well. For example, a deflection angle of zero excites 100% of the segments. However, at half the maximum angle 50% of the segments are excited. At the maximum angle, the minimum number of segments are excited. FIG. 19B provides an alternate structure to the structure of FIG. 19A but where a deflection angle of zero excites the minimum number of segments and at the maximum angle, the maximum number of segments are excited While the above has been discussed in terms of elements emitting red, green and blue light, the present invention is not so limited. The resonant structures may be utilized to produce a desired wavelength by selecting the appropriate parameters (e.g., beam velocity, finger length, finger period, finger height, duty cycle of finger period, etc.). Moreover, while the above was discussed with respect to three-wavelengths per element, any number (n) of wavelengths can be utilized per element.

As should be appreciated by those of ordinary skill in the art, the emissions produced by the resonant structures 110 can additionally be directed in a desired direction or otherwise altered using any one or a combination of: mirrors, lenses and filters.

The resonant structures (e.g., 110R, 110G and 110B) are processed onto a substrate 105 (FIG. 3) (such as a semiconductor substrate or a circuit board) and can provide a large number of rows in a real estate area commensurate in size with an electrical pad (e.g., a copper pad).

The resonant structures discussed above may be used for actual visible light production at variable frequencies. Such applications include any light producing application where incandescent, fluorescent, halogen, semiconductor, or other light-producing device is employed. By putting a number of resonant structures of varying geometries onto the same substrate 105, light of virtually any frequency can be realized by aiming an electron beam at selected ones of the rows.

Figure 20:
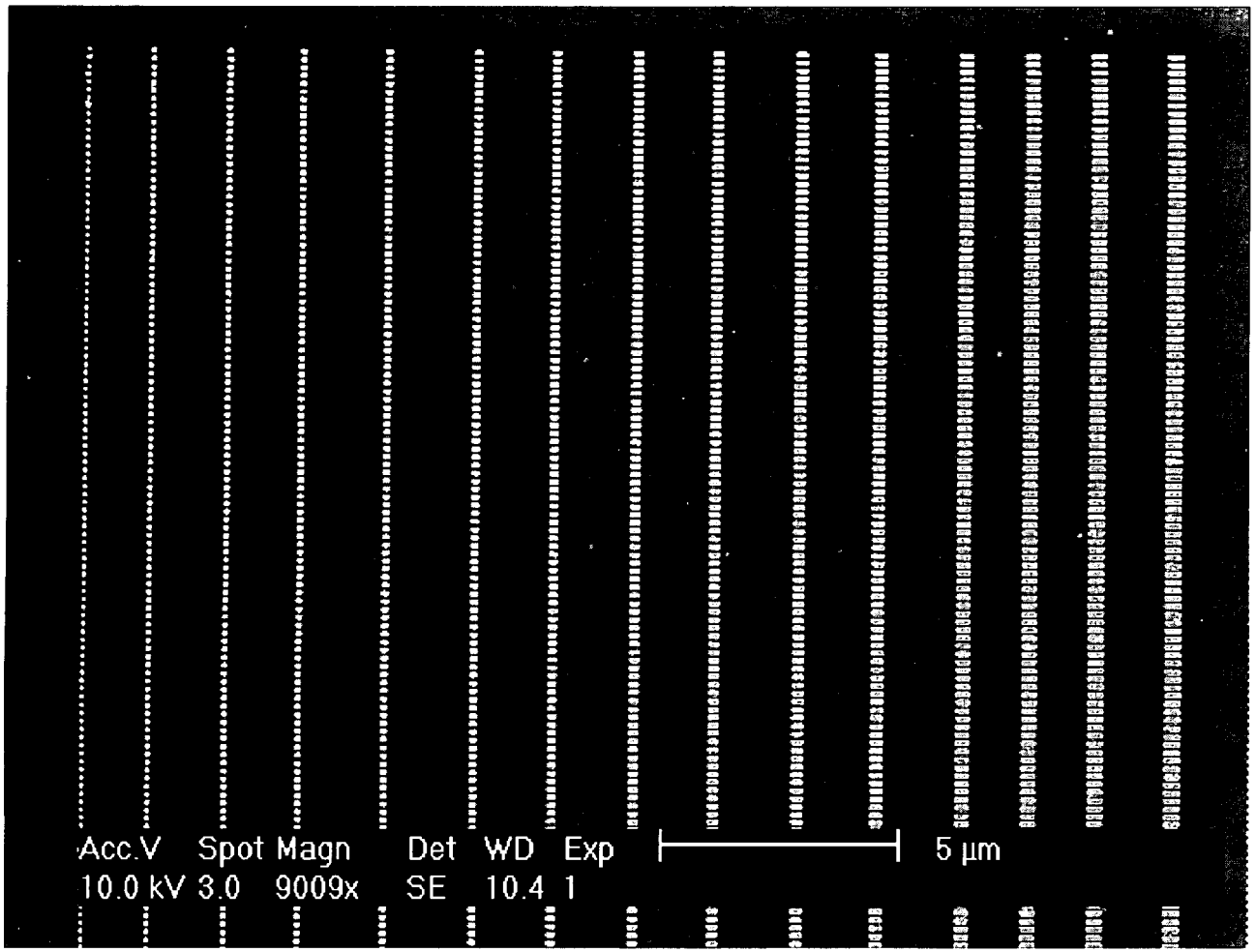
FIG. 20 is a microscopic photograph of a series of resonant segments.

FIG. 20 shows a series of resonant posts that have been fabricated to act as segments in a test structure. As can be seen, segments can be fabricated having various dimensions.

The above discussion has been provided assuming an idealized set of conditions—i.e., that each resonant structure emits electromagnetic radiation having a single frequency. However, in practice the resonant structures each emit EMR at a dominant frequency and at least one "noise" or undesired frequency. By selecting dimensions of the segments (e.g., by selecting proper spacing between resonant structures and lengths of the structures) such that the intensities of the noise frequencies are kept sufficiently low, an element 100 can be created that is applicable to the desired application or field of use. However, in some applications, it is also possible to factor in the estimate intensity of the noise from the various resonant structures and correct for it when selecting the number of resonant structures of each color to turn on and at what intensity. For example, if red, green and blue resonant structures 110R, 110G and 100B, respectively, were known to emit (1) 10% green and 10% blue, (2) 10% red and 10% blue and (3) 10% red and 10% green, respectively, then a grey output at a selected level ($level_s$) could be achieved by requesting each resonant structure output $level_s/(1+0.1+0.1)$ or $level_s/1.2$.

In addition to the arrangements described above, it is also possible to incorporate passive optical devices, structures or components into the emitter structures. Or the various groupings of such structures, as described herein.

Figure 21A:
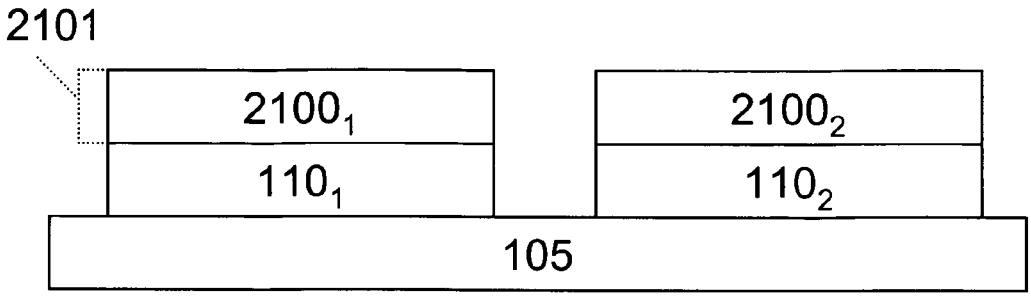
FIG. 21A is a cross-sectional view of micro-resonant structures and their corresponding passive optical elements.

As shown in FIG. 21A, a base or substrate 105 can have arranged thereon at least one resonant structure such as those labeled as $\mathbf{110}_1$ and $\mathbf{110}_2$. These resonant structures can be made by a number of processes including those noted above and which have been previously been incorporated herein by reference. While each of those resonant structures could be used by themselves, it is also possible to combine them with one or more passive optical structures. Such passive optical structures can be formed from a wide variety of materials including transparent materials such as glass, or plastics, translucent materials, thin films, or filters or filter material. In addition, such passive optical structures could include multiple layers of materials, layers with different indexes of refraction, layers that could transmit different frequencies, and/or wavelengths, depending upon the desired output of emitted EMR.

For example, where a plurality of resonant structures are formed on the substrate 105, as shown in FIG. 21A at $\mathbf{110}_1$ and $\mathbf{110}_2$, respective passive optical structures $\mathbf{2100}_1$ and $\mathbf{2100}_2$ can be formed thereon, for example in a one-to-one correlation. These passive optical structures $\mathbf{2100}_1$ and $\mathbf{2100}_2$ can be formed using one of a variety of patterning techniques followed by suitable etching and plating, or other deposition techniques. Some such techniques are discussed in U.S. patent application Ser. Nos. 10/917,511 and 11/203,407 referenced above and incorporated herein by reference, so further discussion is not required herein. Each passive optical structure could also be formed so that its exterior boundary extends outwardly beyond an exterior boundary of the underlying resonant structure as is shown for one portion in dotted line at 2101.

In FIG. 21A, passive optical structures have been formed directly on an underlying resonant structure so that they occupy or have substantially the same exterior outline or profile as that of the underlying resonant structure on which it is formed.

Figure 21B:
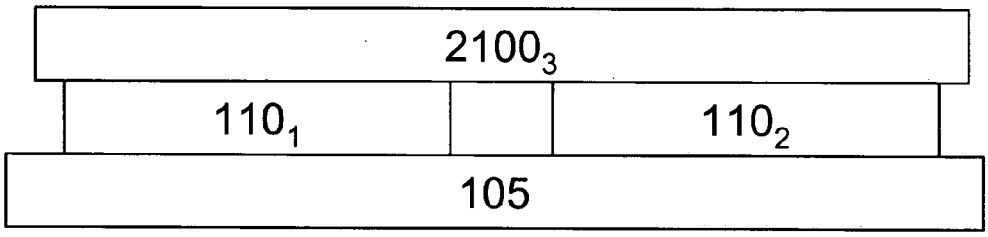
FIG. 21B is a cross-sectional view of micro-resonant structures having a shared passive optical element.

Alternatively, as shown in FIG. 21B, another embodiment of such passive optical structures shows them as being in the form of a dimensionally larger structure, such as $\mathbf{2100}_3$, that could either span or extend beyond the exterior shape or profile of the underlying resonant structure or structures, or span across a plurality of underlying resonant structures, or even could extend across all of the underlying resonant structures. In this embodiment, for example, this is shown by having the passive optical structure $\mathbf{2100}_3$ extending both across and beyond the underlying resonant structures $\mathbf{110}_1$ and $\mathbf{110}_2$.

Figure 21C:
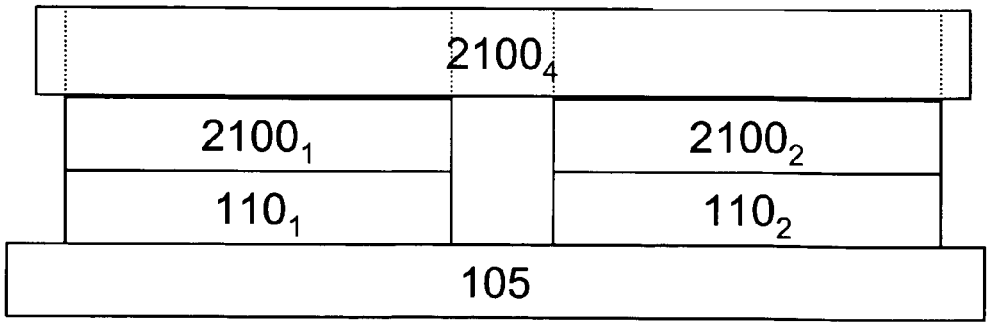
FIG. 21C is a cross-sectional view of micro-resonant structures having both respective passive optical elements and a shared passive optical element.

In yet another embodiment, as shown in FIG. 21C, the passive optical structure $\mathbf{2100}_4$ could itself be formed indirectly on one of more of the resonant structures such as $\mathbf{110}_1$ and $\mathbf{110}_2$, such as by being formed on another intermediate material, or on one or more intermediate passive optical structures $\mathbf{2100}_1$ and $\mathbf{2100}_2$. Here again, the size, shape and/or dimensions of the outer most passive optical structure $\mathbf{2100}_4$ could be the same as the underlying structure, the same as the underlying passive optical structure $\mathbf{2100}_1$ or $\mathbf{2100}_2$, as shown by the vertically oriented dotted lines in FIG. 21C, or the outer most passive optical structure could span across a plurality of or all of the underlying intermediate structures as is shown in full lines in FIG. 21C.

As can be understood from the foregoing, any material and geometry combination that can couple with the radiation from the main underlying resonant structures can be used and is contemplated as being part of this invention.

FIGS. 22A-22E show another series of variations of different embodiments where lenses and filters can be utilized to vary the light output, the effects achieved and the visual effects actually perceived.

Figure 22A:
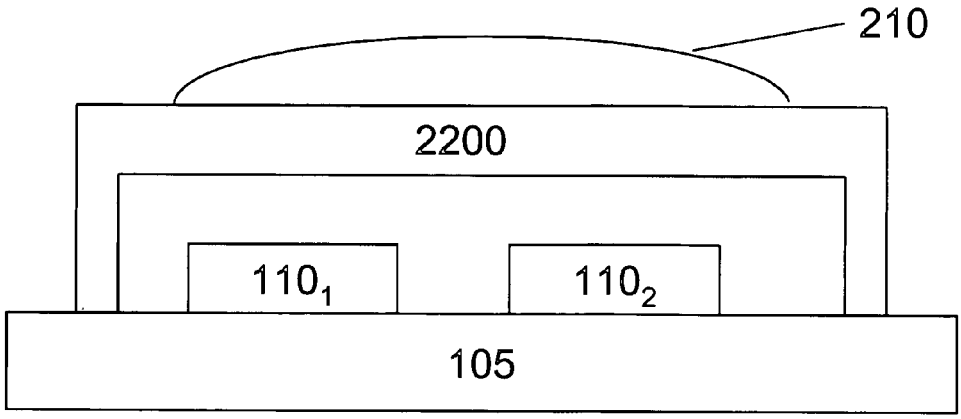
FIG. 22A is a cross-sectional view of micro-resonant structures and an optical lens.

In FIG. 22A, the substrate 105 is again provided with a plurality of resonant structures as are shown at $\mathbf{110}_1$ and $\mathbf{110}_2$. A dielectric or polymer structure 2200, also a passive optical structure, is formed to overlie the resonant structures $\mathbf{110}_1$ and $\mathbf{110}_2$. This dielectric or polymer structure 2200 can be formed in place or manufactured separately and then mounted or installed to overlie the resonant structures. The exact shape and dimensions of the dielectric or polymer structure 2200 are not critical as the dielectric or polymer structure 2200 is provided primarily to act as a support for a refractive optical lens 210, or a diffractive lens or any kind of lens considered useful, that has been separately formed or provided on the upper surface of the dielectric or polymer structure 2200. The EMR being emitted by the resonant structures $\mathbf{110}_1$ and $\mathbf{110}_2$ can pass through the dielectric or polymer structure 2200 and then through the lens 2200 which can focus or otherwise direct the emitted radiation in a desired way and/or direction.

Figure 22B:
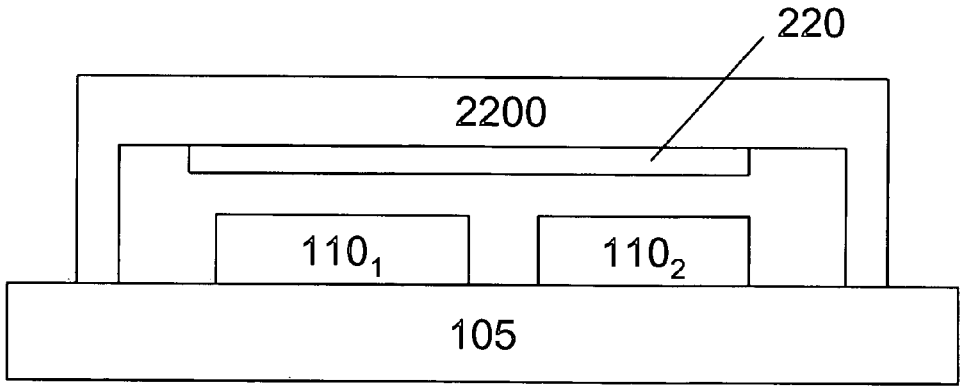
FIG. 22B is a cross-sectional view of micro-resonant structures and an overlying passive element together with a filter.
Figure 22C:
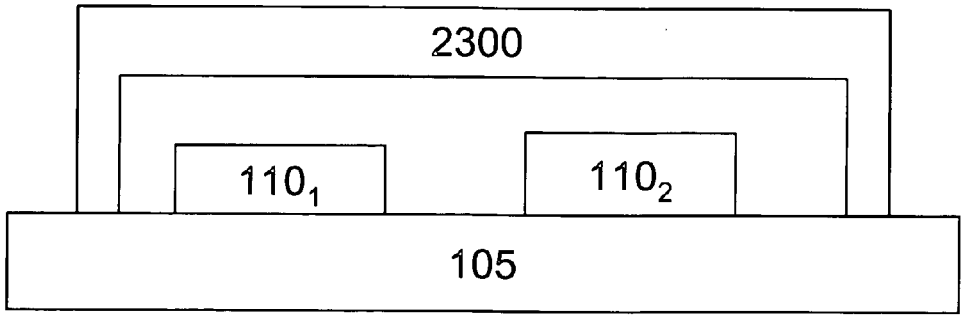
FIG. 22C is a cross-sectional view of micro-resonant structures and a filter structure directly there over.

Control over the specific waves or frequencies being propagated can also be controlled by incorporating a suitable filter such as that shown at 220 in FIG. 22B. Here, the filter 220 is mounted on the interior of the dielectric or polymer structure 2200 and above the resonant structures. It should be understood that filter 220 could also be mounted on the top of the structure 2200 or on both the top and bottom, so that the location on the bottom, as shown, is not a limiting condition. Filter 220 could be a photon sieve or another type of filter, such as, for example, interference filters and/or absorption filters or combinations thereof, again depending upon the desired output, frequency, wavelength and/or direction. In fact, the filter 220 could also be comprised of a combination of filtering materials depending upon the desired waveform or frequency that is sought to be emitted or received, including thin films, metal layers, dielectric materials or other filtering materials, or filter 220 could even in the form of a of prism.

FIG. 22C again shows the base substrate 105 on which resonant structures $\mathbf{110}_1$ and $\mathbf{110}_2$ are formed. Rather than forming a dielectric or polymer structure 2200, as in the previous figures, a filter 2300 can be formed in place of the dielectric or polymer structure 2200. In each of the foregoing FIGS. 22A-C, the function of the lens and filters is to focus or disperse the emitted or received EMR in a desired way or direction.

Figure 22D:
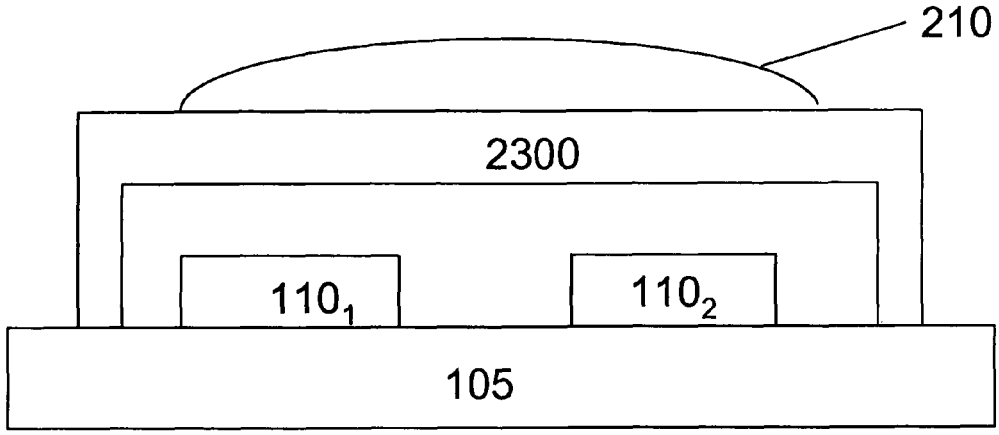
FIG. 22D is cross-sectional view of micro-resonant structures and a filter together with an optical lens.

FIG. 22D shows another embodiment that combines the lens 210 and the filter material 2300 that have been formed or placed over the underlying substrate and the resonant structures $\mathbf{110}_1$ and $\mathbf{110}_2$ thereby allowing the desired frequencies and wavelengths to be focused or otherwise directed by lens 210.

Figure 22E:
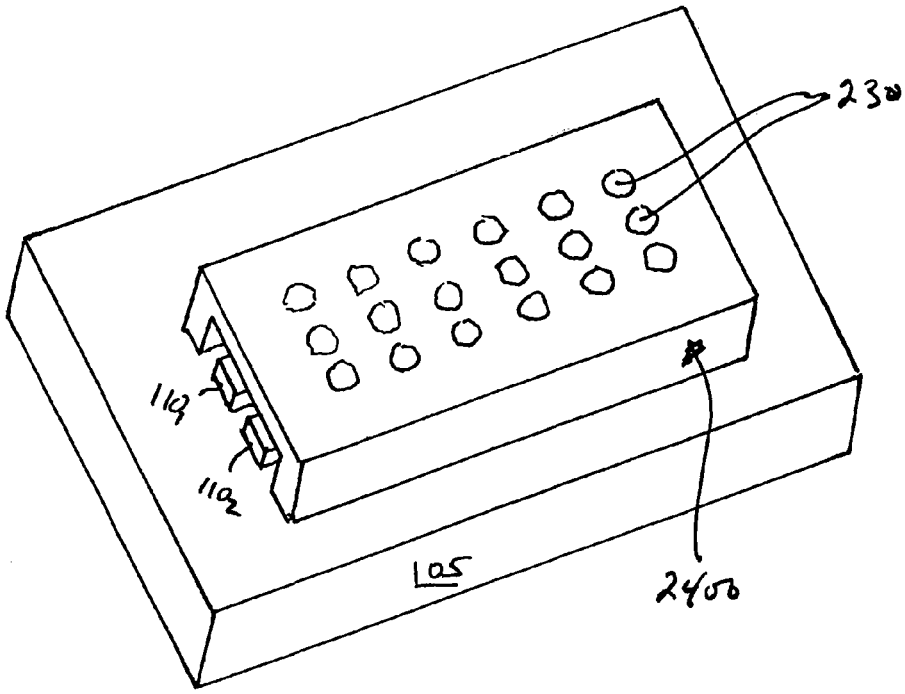
FIG. 22E is a perspective view of micro-resonant structures and a photonic crystal formed there over.

FIG. 22E shows another embodiment that also begins with the substrate 105, on which a plurality of resonant structures $\mathbf{110}_1$ and $\mathbf{110}_2$ have been formed, and over which a structure 2400, comprising a photonic crystal, has been formed. Such a photonic crystal can be formed from a wide variety of materials, including any dielectric material such as alumina in which holes 230 are provided or where the holes have been filled with a compatible or even a different material, such as, for example, tantala. This photonic crystal will provide another way to control the emitted EMR and thereby the resulting energy coming from the resonant structures $\mathbf{110}_1$ and $\mathbf{110}_2$. It should also be understood that a photon sieve or other diffractive lens could also be used in place of the photonic crystal to achieve the desired control over the emitted EMR or even a combination of a photonic crystal and a diffractive lens.

Thus, there could be use of passive optical structures in conjunction with the resonant structures, either directly or indirectly, or in combination with one or more other intermediate structures, with the latter possibly also comprising passive optical structures. Similarly, the passive optical structure can be formed on a resonant structure to have substantially the shape of that underlying resonant structure, the passive optical structures could span beyond the outer profile of the underlying resonant or other underlying structure, in which case the passive optical structures would not have an exterior shape or profile that would be the same as the underlying structure on which it was formed, or the passive optical structures could extend outwardly beyond and cover a plurality of underlying structures.

Additional details about the manufacture and use of such resonant structures are provided in the above-referenced co-pending applications, the contents of which are incorporated herein by reference.

The structures of the present invention may include a multi-pin structure. In one embodiment, two pins are used where the voltage between them is indicative of what frequency band, if any, should be emitted, but at a common intensity. In another embodiment, the frequency is selected on one pair of pins and the intensity is selected on another pair of pins (potentially sharing a common ground pin with the first pair). In a more digital configuration, commands may be sent to the device (1) to turn the transmission of EMR on and off, (2) to set the frequency to be emitted and/or (3) to set the intensity of the EMR to be emitted. A controller (not shown) receives the corresponding voltage(s) or commands on the pins and controls the director to select the appropriate resonant structure and optionally to produce the requested intensity.

While certain configurations of structures have been illustrated for the purposes of presenting the basic structures of the present invention, one of ordinary skill in the art will appreciate that other variations are possible which would still fall within the scope of the appended claims.

We claim:

1. A frequency selective electromagnetic radiation emitter, comprising:

a charged particle generator configured to generate a beam of charged particles;

a plurality of resonant structures configured to resonate at a frequency higher than a microwave frequency when exposed to the beam of charged particles, and at least one passive optical structure formed in conjunction with at least one of the plurality of resonant structures.

2. The emitter according to claim 1, wherein the at least one passive optical structure is formed from at least one material from the group of silica, alumina, and polymer.

3. The emitter according to claim 1, further including a plurality of passive optical structures with each passive optical structure being formed directly on one of said plurality of resonant structures.

4. The emitter according to claim 3, wherein each resonant structure has an exterior shape and each of the plurality of passive optical structures have substantially the exterior shape of the underlying resonant structure on which it is formed.

5. The emitter according to claim 1, further including a plurality of passive optical structures with each passive optical structure being formed indirectly on one of said plurality of resonant structures.

6. The emitter according to claim 5, wherein each resonant structure has an exterior shape and each of the plurality of passive optical structures have substantially the exterior shape of the underlying resonant structure on which it is formed.

7. The emitter according to claim 3, wherein at least one of the plurality of passive optical structures is formed to extend outwardly beyond an exterior boundary of at lest one of the plurality of resonant structures on which it is formed.

8. The emitter according to claim 5, wherein at least one of the plurality of passive optical structures is formed to extend outwardly beyond an exterior boundary of at least one of the plurality of resonant structures on which it is formed.

9. The emitter according to claim 1, wherein the at least one passive optical structure is formed to extend across a plurality of resonant structures.

10. The emitter according to claim 1, wherein the at least one passive optical structure is formed directly on a resonant structure.

11. The emitter according to claim 1, wherein the at least one passive optical structures is formed indirectly on a resonant structure.

12. The emitter according to claim 1, wherein at least one passive optical structures is formed on an intermediate structure positioned between the resonant structure and the passive optical structure.

13. The emitter according to claim 12, wherein the intermediate structure has an exterior shape that substantially corresponds to an exterior shape of the underlying resonant structure on which it is formed.

14. The emitter according to claim 13, wherein the at least one passive optical structure has substantially the exterior shape of the underlying intermediate structure on which it is formed.

15. The emitter according to claim 1, wherein each of the plurality of resonant structures has an intermediate structure formed thereon and the at least one passive optical structure is formed to extend outwardly across a plurality of the intermediate structure and resonant structure combinations.

16. The emitter according to claim 1, wherein the at least one passive optical structure is formed to extend outwardly beyond an exterior boundary of the resonant structure on which it is formed.

* * * * *